US010538401B2

(12) United States Patent
Fujita

(10) Patent No.: US 10,538,401 B2
(45) Date of Patent: Jan. 21, 2020

(54) SHEET FEEDING APPARATUS AND IMAGE FORMING APPARATUS

(71) Applicant: CANON KABUSHIKI KAISHA, Tokyo (JP)

(72) Inventor: Keiko Fujita, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 399 days.

(21) Appl. No.: 15/229,563

(22) Filed: Aug. 5, 2016

(65) Prior Publication Data

US 2017/0068199 A1 Mar. 9, 2017

(30) Foreign Application Priority Data

Sep. 3, 2015 (JP) ..... 2015-173510

(51) Int. Cl.
*B65H 5/06* (2006.01)
*B65H 7/02* (2006.01)
*B65H 3/06* (2006.01)

(52) U.S. Cl.
CPC ..... *B65H 5/062* (2013.01); *B65H 3/0669* (2013.01); *B65H 7/02* (2013.01)

(58) Field of Classification Search
CPC ..... B65H 5/062; B65H 3/0669; B65H 3/0684
See application file for complete search history.

(56) References Cited

U.S. PATENT DOCUMENTS 6,741,815 B1 5/2004 Fujita et al.
7,597,311 B2 10/2009 Kawata et al.
8,047,539 B2 11/2011 Fujita
8,186,674 B2 5/2012 Fujita
8,322,705 B2 * 12/2012 Oka ..... B65H 7/02 271/117
8,480,082 B2 * 7/2013 Kannari ..... B65H 3/0607 271/10.12
8,864,123 B2 10/2014 Kamiyama et al.
2006/0049572 A1 * 3/2006 Miyazawa ..... B65H 3/06 271/121
2008/0211171 A1 * 9/2008 Kusumi ..... B65H 3/44 271/225
2010/0111583 A1 5/2010 Fujita
2011/0031680 A1 * 2/2011 Oka ..... B65H 7/02 271/110

FOREIGN PATENT DOCUMENTS

JP 2001-348129 A 12/2001

* cited by examiner

*Primary Examiner* — Thomas A Morrison
(74) *Attorney, Agent, or Firm* — Venable LLP

(57) ABSTRACT

A sheet feeding apparatus includes a feed roller configured to feed a sheet in a feeding direction, a drive unit to drive the feed roller, a separation roller driven by the drive unit through a torque limiter in a direction against the feeding direction, and a pair of conveyance rollers. In addition, a control portion executes a first control mode in which a first sheet is conveyed and a second control mode in which a second sheet having a lower basis weight than that of the first sheet is conveyed. The control portion stops the drive unit with the sheet nipped at a separation nip portion and at a conveyance nip portion in each of the first and second control modes, and a timing when the drive unit is stopped by the control portion in the second control mode is earlier than a timing when the drive unit is stopped by the control portion in the first control mode.

15 Claims, 16 Drawing Sheets

SHEET FEEDING APPARATUS AND IMAGE FORMING APPARATUS

BACKGROUND OF THE INVENTION

Field of the Invention

This disclosure relates to a sheet feeding apparatus configured to separate and feed sheets and an image forming apparatus including the sheet feeding apparatus.

Description of the Related Art

In many cases, a sheet feeding apparatus provided in an image forming apparatus is configured to separate sheets stacked on a stacking member such as a cassette one by one with a feed roller and the like, and to feed the sheets to a conveyance portion disposed downstream of the feed roller.

Japanese Patent Laid-Open No. 2001-348129 discloses a paper feeder that includes a feed roller configured to feed a paper stacked on a feed tray, a registration roller conveying the sheet to a downstream side of the feed roller, and a control portion to which a sheet size is inputted through an operation panel. The paper feeder causes the feed roller to start rotating, and then, causes the feed roller to stop being driven at a timing at which a trailing edge of a sheet reaches the feed roller, based on the length of the sheet in a feeding direction. In the paper feeder, since the feed roller is continuously driven even after the sheet reaches the registration roller, the registration roller provides assistance to the conveying force of the sheet.

Incidentally, there has been known a sheet feeding apparatus having a configuration for separating sheets using a separation roller. In other words, the sheet feeding apparatus has the configuration that includes a feed roller feeding a sheet in the feeding direction, a separation roller disposed in a pressure contact with the feed roller and to be driven through a torque limiter in a direction against the feeding direction, and a drive unit that drives the feed roller and the separation roller. In this configuration, at least during a period in which the feed roller is driven, drive force is inputted to the separation roller in order to improve sheet separation performance of the separation roller.

Similar to the paper-sheet feeding apparatus disclosed in the above document, in such a sheet feeding apparatus, it is considered that the feed roller continues to be driven even after the sheet reaches the conveyance portion on the downstream side of the feed roller such that the feed roller provides assistance to the convey of the sheet by the conveyance portion. In this manner, it can be expected that double feeding is prevented and the sheet can be stably conveyed.

However, in a case of employing such a configuration, the separation roller repeatedly rotates normally and reversely little by little and vibrates in some cases when the sheet is fed. Then, in the case where a sheet having low stiffness is conveyed, the amplitude of the vibration of the separation roller tends to be increased, compared to a case where a sheet having high stiffness is conveyed. In the case where the separation roller continues vibrating with high amplitude, there is a concern that harsh vibration noise will be produced.

SUMMARY OF THE INVENTION

A sheet feeding apparatus according to one aspect of this disclosure includes a feed roller configured to feed a sheet in a feeding direction, a drive unit configured to drive the feed roller, a separation roller connected to the drive unit through a torque limiter, a conveyance portion configured to convey the sheet with a conveyance nip portion at which the sheet is nipped, and a control portion configured to execute a first control mode in which a first sheet is conveyed and a second control mode in which a second sheet having a lower basis weight than that of the first sheet is conveyed. The conveyance nip portion is disposed downstream of the separation nip portion in the feeding direction. The separation roller is configured to be driven in a direction against the feeding direction so that sheets are separated at a separation nip portion formed between the feed roller and the separation roller. The control portion starts the drive unit, and stops the drive unit with the sheet nipped at both nips of the separation nip portion and the conveyance nip portion in each of the first and second control modes. The control portion sets a stop timing of the drive unit in the first control mode to a timing later than that in the second control mode.

A sheet feeding apparatus according to another aspect of this disclosure includes a feed roller configured to feed a sheet in a feeding direction, a drive unit configured to drive the feed roller, a separation roller connected to the drive unit through a torque limiter, a conveyance portion configured to convey the sheet with a conveyance nip portion at which the sheet is nipped, and a control portion configured to execute a first control mode in which a first sheet is conveyed and a second control mode in which a second sheet having a lower basis weight than that of the first sheet is conveyed. The conveyance nip portion is disposed downstream of the separation nip portion in the feeding direction. The separation roller is configured to be driven in a direction against the feeding direction so that sheets are separated at a separation nip portion formed between the feed roller and the separation roller. The control portion starts the drive unit, and stops the drive unit with the sheet nipped at both nips of the separation nip portion and the conveyance nip portion in each of the first and second control modes. The control portion sets a stop timing of the drive unit in the first control mode to a timing later than that in the second control mode.

Further features of the present invention will become apparent from the following description of exemplary embodiments with reference to the attached drawings. The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Now, embodiments of this disclosure will be described with reference to the drawings. It is noted that, in the following description, a state in which an image forming apparatus is seen from a front side, i.e., viewpoint of FIG. 1, is used as reference to describe positional relationships in vertical and left-and-right directions.

First Embodiment

Figure 1:
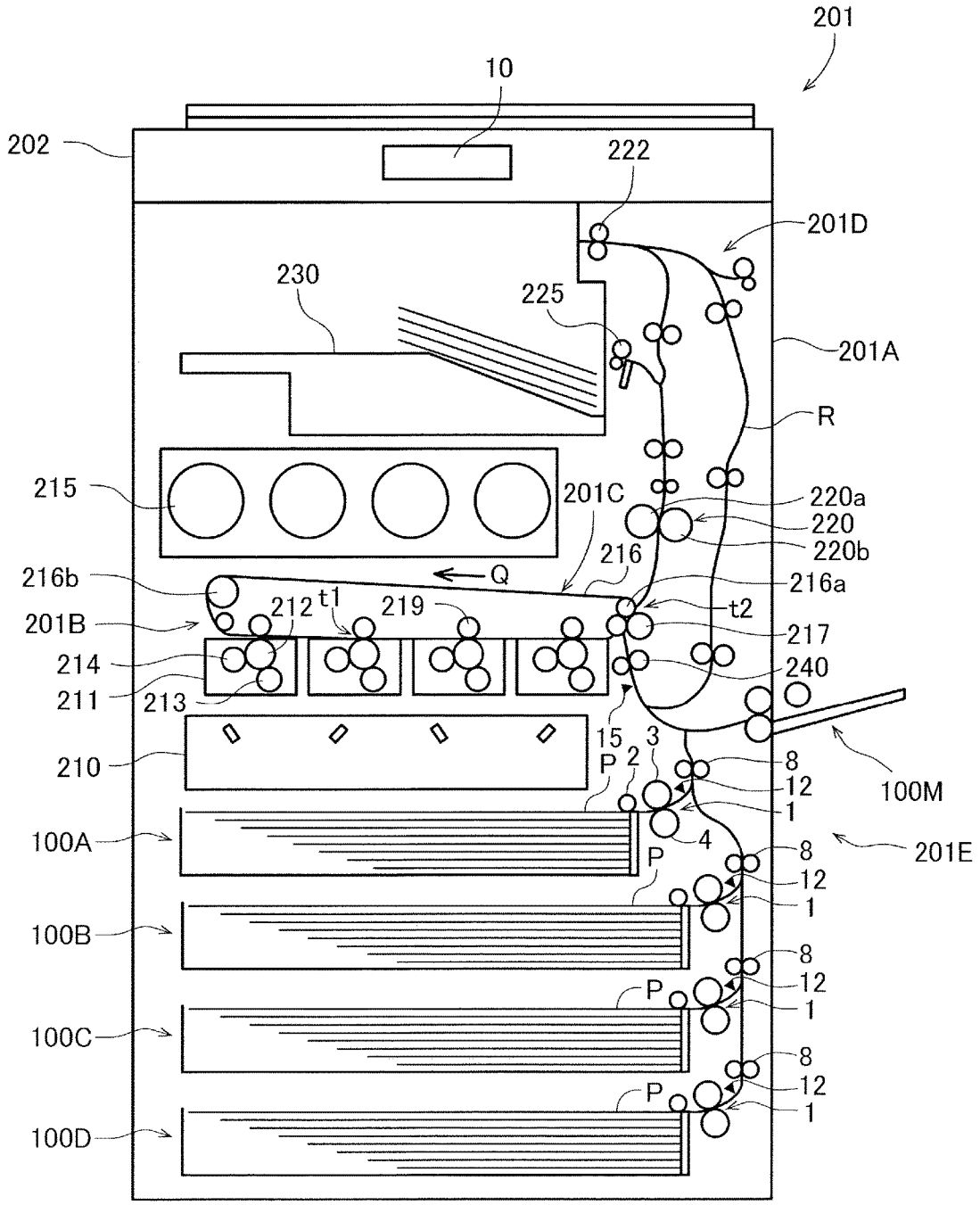
FIG. 1 is a view of a general arrangement illustrating an image forming apparatus according to a first embodiment.

An image forming apparatus 201 according to the first embodiment is an image forming apparatus such as a full-color laser printer, a general arrangement of which is illustrated in FIG. 1. The image forming apparatus 201 includes an image forming unit 201B forming an image on a sheet P and a fixing portion 220 fixing an image on the sheet P, in an apparatus body 201A, i.e., a printer body or an image forming apparatus body. An image reading apparatus 202 reading an image data of a document is arranged above the apparatus body 201A in a posture in which a supporting surface of the document is positioned approximately horizontally. A sheet discharge tray 230 is provided in a discharge space to which the sheet P is discharged between the image reading apparatus 202 and the apparatus body 201A. Further, a sheet feeding unit 201E feeding sheets P to the image forming unit 201B is provided in the apparatus body 201A. The sheet feeding unit 201E includes sheet feeding apparatuses 100A, 100B, 100C and 100D arranged at a lower portion of the apparatus body 201A, and a manual sheet feeding apparatus 100M arranged at a right side portion of the apparatus body 201A.

The image forming unit 201B is a so-called four-drum full-color image forming unit having a laser scanner 210, four process cartridges 211, and an intermediate transfer unit 201C. The process cartridges form toner images of respective colors, which are yellow (Y), magenta (M), cyan (C) and black (K). Each process cartridge 211 includes a photosensitive drum 212, (photoconductive member), a charger 213, a developer 214, and a cleaner (not illustrated). It is noted that a toner cartridge 215 storing toners of respective colors is detachably attached to the apparatus body 201A at an upper portion of the image forming unit 201B.

The intermediate transfer unit 201C includes an intermediate transfer belt 216, i.e., intermediate transfer body, wound around a drive roller 216*a* and a tension roller 216*b*, and the unit is arranged above the four process cartridges 211. The intermediate transfer belt 216 is arranged to contact the photosensitive drums 212 of the respective process cartridges 211, and driven to rotate in a counterclockwise direction, i.e., direction of arrow Q, by the drive roller 216*a* driven by a drive unit (not illustrated). The intermediate transfer unit 201C has primary transfer rollers 219 that contact an inner peripheral surface of the intermediate transfer belt 216 at positions opposing to the respective photosensitive drums 212, and primary transfer portions t1 are formed as nip portions of the intermediate transfer belt 216 and the photosensitive drums 212. Further, the image forming unit 201B includes a secondary transfer roller 217 that contacts an outer peripheral surface of the intermediate transfer belt 216 at a position opposing to the drive roller 216*a*. A secondary transfer portion t2 where a toner image borne on the intermediate transfer belt 216 is transferred to the sheet P is formed as a nip portion of the secondary transfer roller 217 and the intermediate transfer belt 216.

In the respective process cartridges 211 arranged as described, an electrostatic latent image is formed on the surface of the photosensitive drum 212 by the laser scanner 210, and toner is supplied from the developers 214 to form toner images of respective colors charged with negative polarity. The toner images are sequentially transferred in multi layers, i.e., primarily transferred, to the intermediate transfer belt 216 at the respective primary transfer portions t1 by applying a transfer bias voltage of positive polarity to the primary transfer rollers 219, and a full-color toner image is formed on the intermediate transfer belt 216.

Simultaneously as the above-described toner image forming process, the sheet P fed from the sheet feeding unit 201E is conveyed toward a registration roller pair 240, i.e., a registration portion, where skewing of the sheet P is corrected by the registration roller pair 240. The registration roller pair 240 conveys the sheet P to the secondary transfer portion t2 at a timing matching the transfer timing of the full-color toner image formed on the intermediate transfer belt 216. The toner image borne on the intermediate transfer belt 216 is secondarily transferred to the sheet P at the secondary transfer portion t2 by applying a transfer bias voltage of positive polarity to the secondary transfer roller 217.

The sheet P to which the toner image has been transferred is heated and pressed by the fixing portion 220, and a color image is fixed onto the sheet P. The fixing portion 220 includes a fixing roller 220*a*, a counter roller 220*b* pressed against the fixing roller 220*a*, and a heater (not illustrated), and configured to convey the sheet P at a speed corresponding to an image forming speed at the secondary transfer portion t2. The sheet P with the fixed image is discharged by a sheet discharge roller pair 225 to the sheet discharge tray 230 and supported on the tray. It is noted that, when images are to be formed on two sides of the sheet P, the sheet P having passed the fixing portion 220 is switched back by a reverse conveyance roller pair 222 capable of forward/reverse rotation provided in a reverse conveyance portion 201D. Thereafter, the sheet P is conveyed again to the image forming unit 201B via a re-transport path R, so as to form an image on the backside of the sheet P.

Sheet Feeding Apparatus

Next, an arrangement of a sheet feeding apparatus will be described with the sheet feeding apparatus 100A as an example. It is noted that the sheet feeding apparatuses 100B, 100C, and 100D arranged below the sheet feeding apparatus 100A have the substantially same arrangement as the sheet feeding apparatus 100A, and thus description thereof is omitted. In addition, in the case where a direction of rotation of a rotary member (roller member) which comes into contact with the sheet P, a direction along with a feeding direction of the sheet P is referred to as a "forward direction", and a direction against the feeding direction is referred to as a "backward direction".

Figure 2:
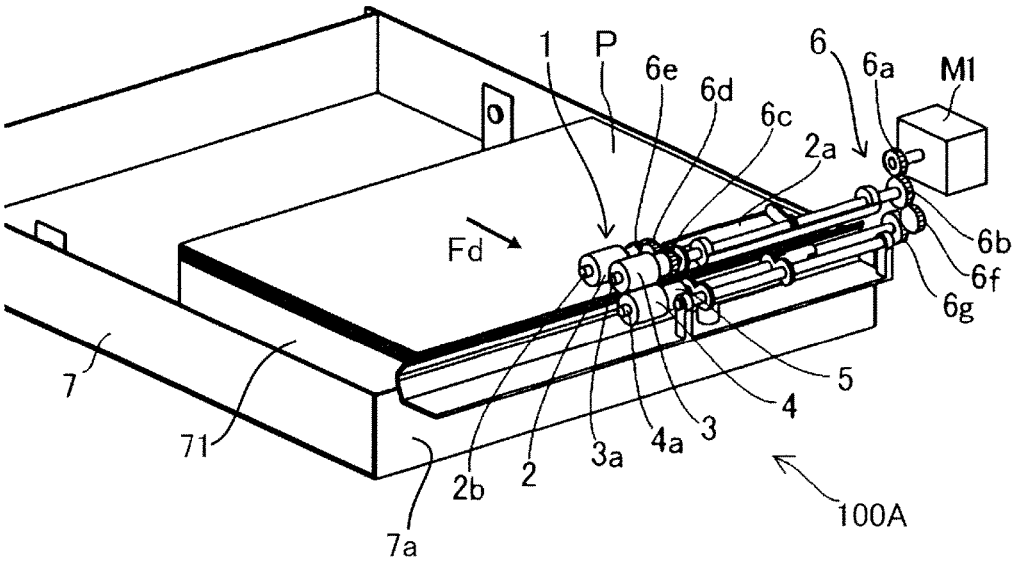
FIG. 2 is a perspective view illustrating a main portion of a sheet feeding apparatus according to the first embodiment.
Figure 3:
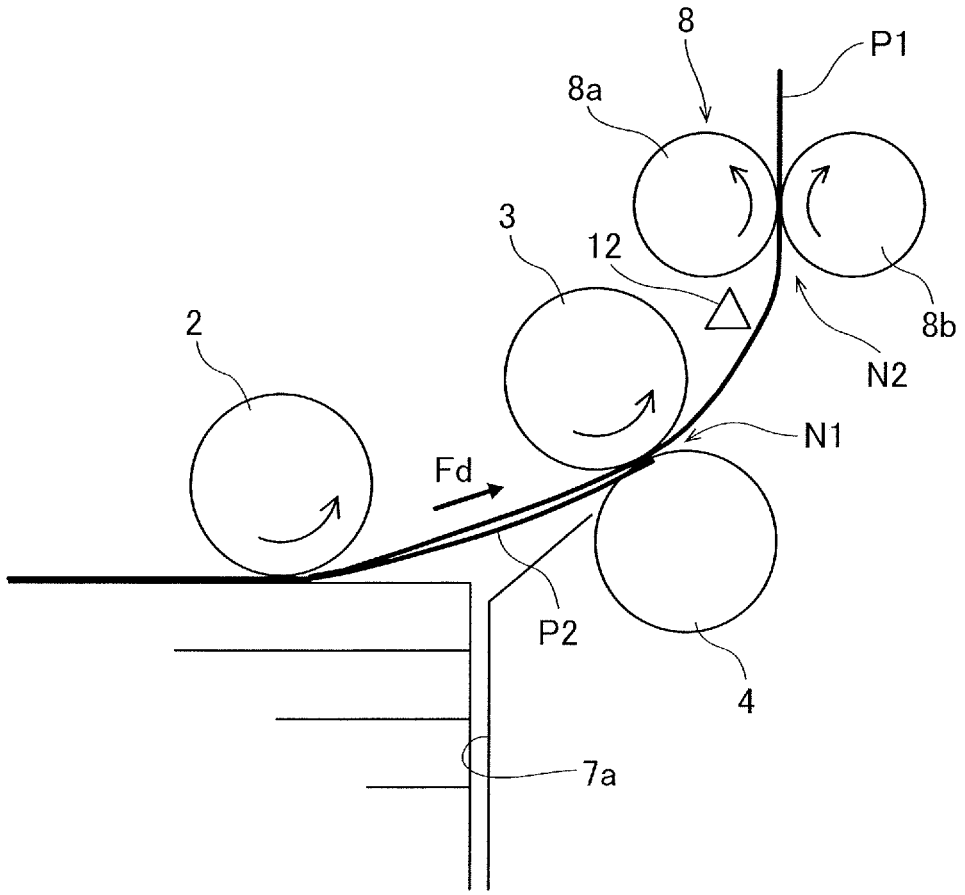
FIG. 3 is a schematic view illustrating an operation of the sheet feeding apparatus in the case where a sheet having high stiffness is conveyed.

As illustrated in FIG. 2, the sheet feeding apparatus 100A includes a feeding cassette 7, a feeding unit 1, and a drawing roller pair 8 (refer to FIG. 3). The feeding cassette 7 serves as a supporting portion that supports the sheet P, and is drawably accommodated in the apparatus body 201A. The feeding cassette 7 includes a side end regulating plate 71 and a trailing edge regulating plate (not illustrated). The sheets P stacked on the feeding cassette 7 are pressed against a cassette wall 7*a* by the trailing edge regulating plate so as to be positioned in the feeding direction (direction of arrow Fd), and are positioned in a width direction by the side end regulating plate 71.

The feeding unit 1, which separates the sheets P stacked on the feeding cassette 7 one by one and conveys the sheet, includes a pickup roller 2, a feed roller 3, a retard roller 4, i.e., a separation roller, and a drive mechanism 6. The pickup roller 2, the feed roller 3, and the retard roller 4 are respectively supported on a pickup roller shaft 2*b*, a feed roller shaft 3*a*, and a retard roller shaft 4*a*, with postures in which axial directions of that rollers are parallel to the width direction (depth direction of the apparatus body 201A) of the sheet P.

The feed roller shaft 3*a* is rotatably supported by a frame member (not illustrated) constituting a supporting frame of the feeding unit 1, and rotatably supports the feed roller 3. The retard roller shaft 4*a* is disposed to be parallel to the feed roller shaft 3*a*, holds the retard roller 4 at a position opposing to the feed roller 3, and is urged by an urging member (not illustrated) so as to cause the retard roller 4 to come into pressure contact with the feed roller 3. The pickup roller shaft 2*b* is attached to a pickup arm 2*a* that is pivotable about the feed roller shaft 3*a* along a vertical direction, and rotatably supports the pickup roller 2.

The drive mechanism 6 includes a group of gears (6*a* to 6*g*), a torque limiter 5, and distributes drive force of a feeding motor M1, which serves as a drive unit provided in the apparatus body 201A, to the respective rollers of the feeding unit 1. The output gear 6*a* provided on an output shaft of the feeding motor M1 meshes with the input gear 6*b* provided on one end of the feed roller shaft 3*a*, and causes the feed roller 3 to rotate in the forward direction along with the feeding direction. The distribution gear 6*c* is provided on the other side of the feed roller shaft 3*a*, and rotation of the distribution gear 6*c* is transmitted to the gear 6*e* provided on the pickup roller shaft 2*b*, via the gear 6*d* supported by the pickup arm 2*a*. Hence, the pickup roller 2 and the feed roller 3 are simultaneously driven to rotate in the forward direction.

It is noted that the pickup arm 2*a* is connected to an urging member (not illustrated) so as to move between a position at which the pickup roller 2 can come into contact with the uppermost sheet P of a sheet bundle stacked on the feeding cassette 7 and a position at which the pickup roller moves away from the uppermost sheet P. In addition, one-way clutches (not illustrated) are provided respectively between the feed roller 3 and the feed roller shaft 3*a*, and between the pickup roller 2 and the pickup roller shaft 2*b*. In other words, each of the feed roller 3 and the pickup roller 2 is able to idle in the forward direction.

The gear 6*g* provided on the retard roller shaft 4*a* is connected to the input gear 6*b* via the idle gear 6*f* such that rotation in the backward direction as the direction against the feeding direction of the sheet P is inputted to the gear 6*g*. The torque limiter 5 is disposed between the retard roller shaft 4*a* and the retard roller 4. The torque limiter 5 transmits drive force of the retard roller shaft 4*a* to the retard roller 4, and allows the retard roller 4 to relatively rotate in the forward direction with respect to the retard roller shaft 4*a* due to an occurrence of slipping in the case where a predetermined amount or greater of torque is applied to the retard roller.

As illustrated in FIG. 3, the drawing roller pair 8 includes a drawing roller 8*a* and a counter roller 8*b*, and serves as a conveyance portion configured to receive the sheet P from the feeding unit 1 and to convey the sheet. The drawing roller 8*a* is disposed to be parallel to the axial direction of the feed roller 3, and is driven to rotate in the forward direction by a drawing motor M2 (refer to FIG. 5). The drawing motor M2 is a conveyance motor provided in the apparatus body 201A. The counter roller 8*b* forms a drawing nip portion N2, i.e., a conveyance nip portion, at which the sheet P is nipped between the drawing roller 8*a* and the counter roller. The counter roller 8*b* is driven to rotate in the forward direction along with the rotation of the drawing roller 8*a*. The drawing nip portion N2 is positioned downstream of the separation nip portion N1 formed between the feed roller 3 and the retard roller 4 in the feeding direction (direction of the arrow Fd) of the sheet P.

It is noted that a feeding sensor 12 that serves as a sheet detection unit configured to detect the sheet P is disposed between the feed roller 3 and the drawing roller 8*a* in the feeding direction. Such an optical sensor may be used as the feeding sensor 12 that includes a light-receiving portion that can detect light radiating from a light-emitting portion, and a flag member that can come into contact with the sheet P while shielding the light-receiving portion from the light. The feeding sensor 12 issues an ON signal in the case where the sheet P passes over a detection position in the vicinity of the sensor. In addition, a registration sensor 15 that detects the sheet P is disposed downstream of the drawing roller pair 8 in the conveyance direction of the drawing roller pair 8, at a position in the vicinity of the registration roller pair 240 on the upstream side thereof (refer to FIG. 1).

Sheet Feeding Operation

Figure 4:
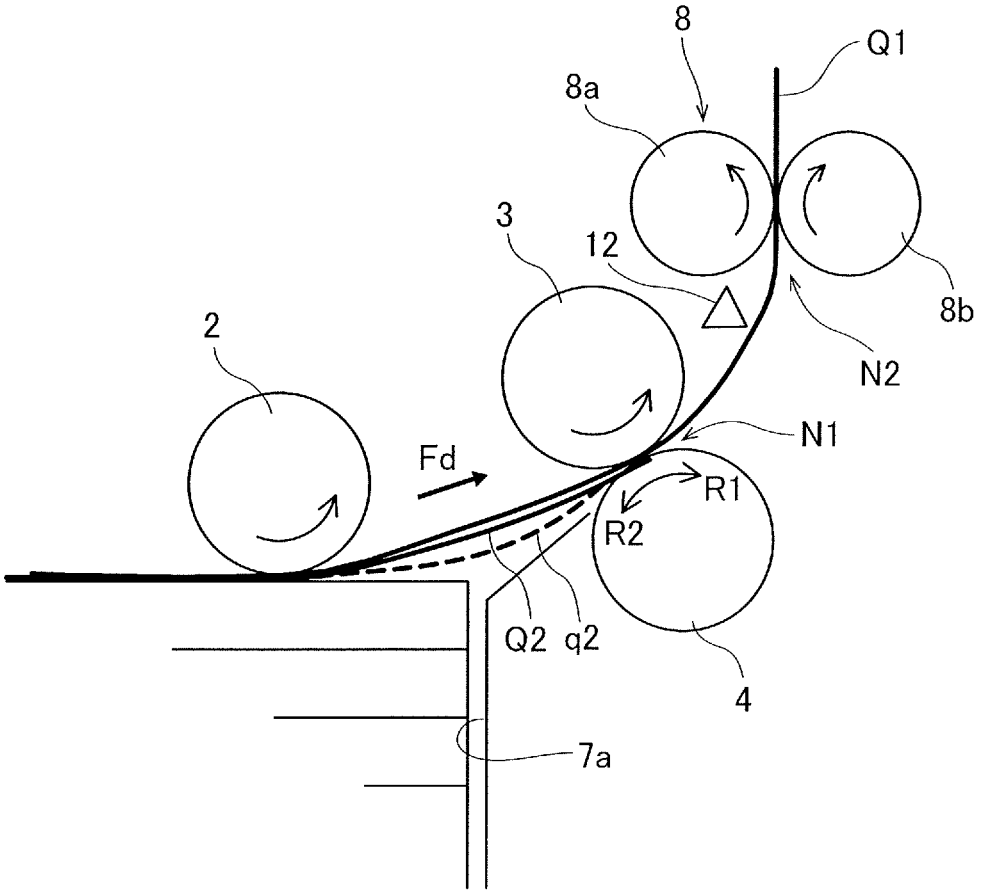
FIG. 4 is a schematic view illustrating an operation of the sheet feeding apparatus in the case where a sheet having low stiffness is conveyed.

Subsequently, an overview of a sheet feeding operation of the sheet feeding apparatus 100A configured as described above will be described with reference to FIGS. 3 and 4. Then, control flow of the sheet feeding operation will be described below in detail. FIG. 3 illustrates a sheet feeding operation performed in the case where a sheet having relatively high stiffness is conveyed, and FIG. 4 illustrates a sheet feeding operation performed in the case where a sheet having relatively low stiffness is conveyed. Here, the stiffness of a sheet means a degree of bending stiffness of a sheet, and thus indicates a magnitude of a value (Clark stiffness or Taber stiffness, for example) that is measured by a method of test such as a Clark method or a Taber method.

As illustrated in FIG. 3, in a state in which the sheets P are stacked in the feeding cassette 7, a leading edge of the sheet as a downstream end in the feeding direction (direction of the arrow Fd) is held at a position close to the cassette wall 7*a*. When the sheet P is fed, the pickup roller 2 comes into pressure contact with the uppermost sheet P1 at a contact position located upstream of the separation nip portion N1. In this state, drive of the feeding motor M1 is started. Then, the sheet P1 is fetched out by the pickup roller 2 in the direction of arrow Fd, reaches the separation nip portion N1, and then is conveyed by the feed roller 3 toward the drawing nip portion N2.

Here, in a state in which only the uppermost sheet P1 approaches the separation nip portion N1, torque in the forward direction is applied to the retard roller 4 through the sheet P1. Then, an occurrence of slipping in the torque limiter 5 allows the retard roller 4 to rotate in the forward direction against the drive force of the retard roller shaft 4*a*. Meanwhile, in a state in which a plurality of sheets P1 and P2 (two sheets in FIG. 3) approach the separation nip portion N1 (double feeding state), the retard roller 4 rotates in the backward direction in accordance with the drive force transmitted through the retard roller shaft 4*a*. In other words, torque capacity of the torque limiter 5 is set to a value greater than friction force to be produced between the stacked sheets P1 and P2. In this manner, the uppermost sheet P1 is conveyed toward the drawing nip portion N2, sheets (P2) other than the uppermost sheet is pushed back to the upstream side of the separation nip portion N1, and thus the double feeding state is solved.

When the leading end of the sheet P1 reaches the drawing nip portion N2, the sheet P1 is nipped between the drawing roller pair 8 driven by the drawing motor M2, and is conveyed to an upper portion inside the apparatus body 201A. Then, the sheet P1 reaches the registration roller pair 240 positioned downstream of the drawing roller pair 8 where skewing of the sheet P1 is corrected, and then the sheet P1 is conveyed to a secondary transfer portion t2.

Here, a phenomenon occurring in a case of the sheet P having low stiffness is described with reference to FIG. 4. FIG. 4 illustrates the sheet feeding apparatus 100A in performing a sheet feeding operation of conveying sheets Q1 and Q2 having stiffness lower than the sheets P1 and P2 illustrated in FIG. 3. In other words, the sheet feeding apparatus 100A is in a state where drive of the feeding motor M1 has been started, conveyance of the uppermost sheet Q1 has been started, and the sheet Q1 having reached the drawing nip portion N2 is nipped at both nips of the separation nip portion N1 and the drawing nip portion N2.

FIG. 4 illustrates a state in which a sheet (double fed sheet Q2) other than the uppermost sheet approaches the separation nip portion N1 due to the friction between the sheets. In this state, when the feeding motor M1 starts the drive, the retard roller 4 starts rotating in a backward direction R2, and the double-fed sheet Q2 is pushed back to the upstream side of the separation nip portion N1. At that time, the double fed sheet Q2 is pressed against the pickup roller 2 through the sheet Q1, and is regulated not to move in a direction opposite to the feeding direction. Therefore, as shown with dashed line q2, the double fed sheet Q2, having low stiffness, comes to be buckled between the pickup roller 2 and the separation nip portion N1.

When the leading edge of the double fed sheet Q2 is pushed back from the separation nip portion N1, the retard roller 4 starts to rotate along with the sheet Q1 in the forward direction R1. Then, the double fed sheet Q2 approaches the separation nip portion N1 again due to the friction force received from the sheet Q1 and restoring force of the sheet Q2. The double fed sheet Q2 repeatedly approaches the separation nip portion N1 and is then pushed back from the separation nip portion N1, and thereby the retard roller 4 enters a state of alternately repeating minute rotations (rotational vibration) in a forward direction R1 and in a backward direction R2. The rotational vibration of the retard roller 4 can continuously occur in the case where the leading edge of the double fed sheet Q2 is present at a position at which the leading edge can approach the separation nip portion N1 and drive force in the backward direction is inputted to the retard roller 4. When the rotational vibration of the retard roller 4 continuously occurs, harsh vibration noise may be perceived in some cases.

Amplitude of the rotational vibration tends to change depending on a material of the sheet which is conveyed by the sheet feeding apparatus, and a conveyance speed (feeding speed) measured when the sheet is conveyed by the feed roller 3. In other words, in the case where the sheet has low stiffness, the amplitude of the rotational vibration tends to increase, compared to the case of the sheet having high stiffness. Therefore, as the basis weight of the sheet is low, and as the sheet is thin, the amplitude of the rotational vibration tends to increase. In addition, in a case of a high feeding speed, the amplitude thereof tends to increase, compared to a case of a low feeding speed.

Selection of Control Mode

The sheet feeding apparatus 100A according to the present embodiment is configured to select, according to a type of sheet, one from a first control mode in which the feeding motor M1 is stopped at a relatively late timing, and a second control mode in which the feeding motor M1 is stopped at a relatively early timing. Hereinafter, selection conditions between the first control mode and the second control mode employed by a control portion 9 will be described.

Figure 5:
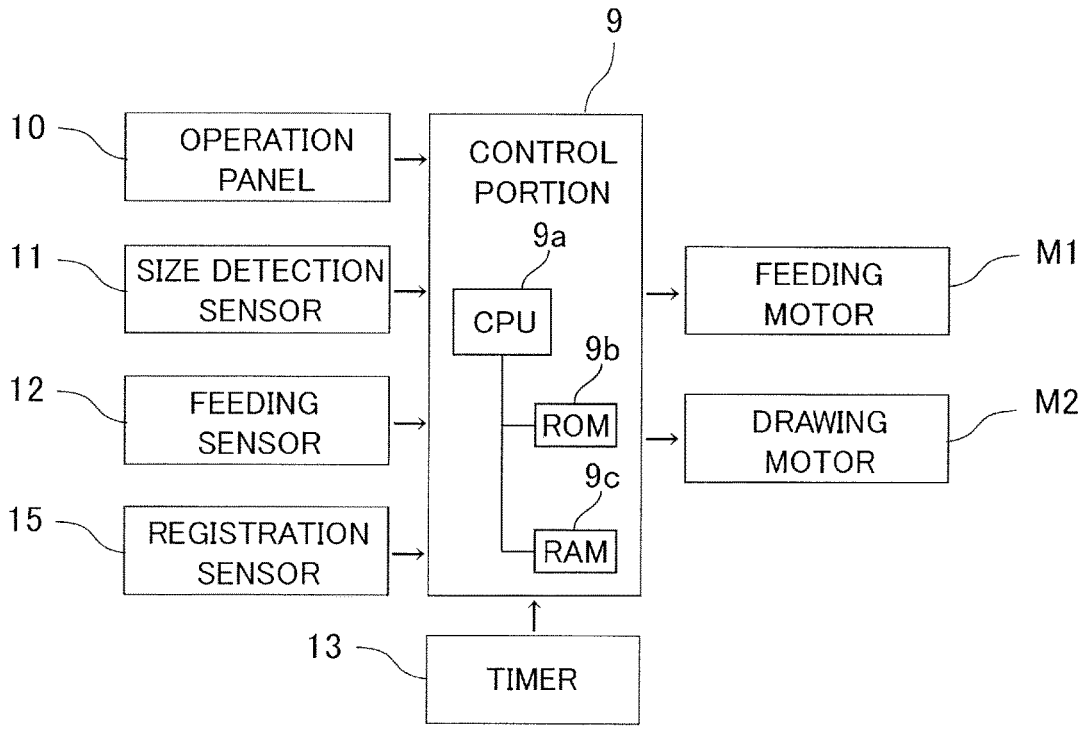
FIG. 5 is a control block diagram according to the first embodiment.

As illustrated in a block diagram in FIG. 5, a control system of the image forming apparatus 201 according to the embodiment has a configuration in which a plurality of input and output devices are connected to the control portion 9. The control portion includes a central processing unit (CPU) 9*a*, a read only memory (ROM) 9*b*, and a random-access memory (RAM) 9*c*. The CPU 9*a* executes such a control program as shown in the flow chart described below, and the ROM 9*b* and the RAM 9*c* store that control program and other data permanently or temporary. An operation panel 10, a size detection sensor 11, a feeding sensor 12, a registration sensor 15, a timer 13, or the like, is connected to the input interface of the control portion 9. In addition, the feeding motor M1 and the drawing motor M2 are connected to the output interface of the control portion 9, and thus the timing of starting and stopping of these motors and output during the drive are controlled by a control signal from the control portion 9. The control portion 9 can count, for example, elapsed time from the start of the feeding motor M1 using the timer 13 as a time count portion.

The size detection sensor 11 as a size detection portion is provided to detect, for example, positions of the side end regulating plate 71 and the trailing edge regulating plate of the feeding cassette 7, thereby detecting the size of the sheet P set in the feeding cassette 7. Here, the size of the sheet P means a length (length of the sheet) in the feeding direction and a length (width of the sheet) in a direction orthogonal to the feeding direction. In the case where a plurality of sheet feeding apparatuses are provided, the size detection sensor 11 and the feeding sensor 12 may be disposed in respective sheet feeding apparatuses.

The operation panel 10, which serves, as an input portion through which a user can input a type of sheet P (a sheet type) that is set in the feeding cassette 7 with respect to the control portion 9, includes a liquid crystal panel and a manual operation button that are exposed to the outside of the apparatus body 201A. Here, the types of sheet P are classified according to a material, basis weight, a dimension, a treated or untreated surface, or the like, of a sheet. A specific example of such classification is a group of a high-quality sheet, a recycled sheet, an OHP film, a coated sheet and the like that are subdivided according to the basis weight. The type of sheet P is selected by a user from choices displayed on the liquid crystal panel and is inputted to the control portion 9.

The control portion 9 is configured to select, according to the type of sheet P, from a plurality of choices, a feeding speed as a conveyance speed of the sheet P (rotation speed of corresponding rollers) in the sheet feeding operation and an image forming speed as a conveyance speed of the sheet P at a secondary transfer portion t2. Table 1 shows a correspondence relationship between types of sheets P and a feeding speed V1 and an image forming speed V2 according to an example of the present embodiment. It is noted that although an exemplary implementation using grams per square meter, i.e., grammage, as a unit of basis weight (sheet weight) will be described below, another amount such as a weight of a standard ream may be adopted as the unit.

TABLE 1

| Selected/inputted information of sheet (P) | | Feeding speed | Image forming speed |
|---|---|---|---|
| Material | Grammage | V1 | V2 |
| High-quality sheet | 52 to 105 g/m$^2$ | 300 mm/sec | 264 mm/sec |
| | 106 to 128 g/m$^2$ | 250 mm/sec | 222 mm/sec |
| | 129 to 256 g/m$^2$ | 150 mm/sec | 132 mm/sec |
| Recycled sheet | 64 to 105 g/m$^2$ | 300 mm/sec | 264 mm/sec |
| | 106 to 128 g/m$^2$ | 250 mm/sec | 222 mm/sec |
| | 129 to 256 g/m$^2$ | 150 mm/sec | 132 mm/sec |
| OHP film | 121 to 220 g/m$^2$ | 150 mm/sec | 132 mm/sec |

As shown in Table 1, the image forming speed V2 is set to a smaller value as the sheet P has high basis weight, and the feeding speed V1 is set to a value substantially proportional to the image forming speed V2. In this manner, an amount of heat which the sheet P receives in the fixing portion 220 is increased, and an image is reliably fixed to the sheet P having high heat capacity and high basis weight.

In the embodiment, in the case where the feeding speed V1 is set to a large value, that is, in the case where the sheet P has first stiffness, the first control mode is selected. In addition, in the case where the feeding speed V1 is set to a small value, that is, in the case where the sheet P has second stiffness lower than the first stiffness, the second control mode is selected. In the example shown in Table 1, the first control mode is applied in the case where the feeding speed V1 is 150 mm/sec, and the second control mode is applied in the case where the feeding speed V1 is 250 mm/sec or 300 mm/sec. It is noted that, in the configuration in which the control mode is selected according to basis weight, the first control mode is selected in the case where a first sheet having first basis weight is conveyed, and the second control mode is selected in the case where a second sheet having second basis weight smaller than the first basis weight is conveyed.

First Control Mode

Figure 6:
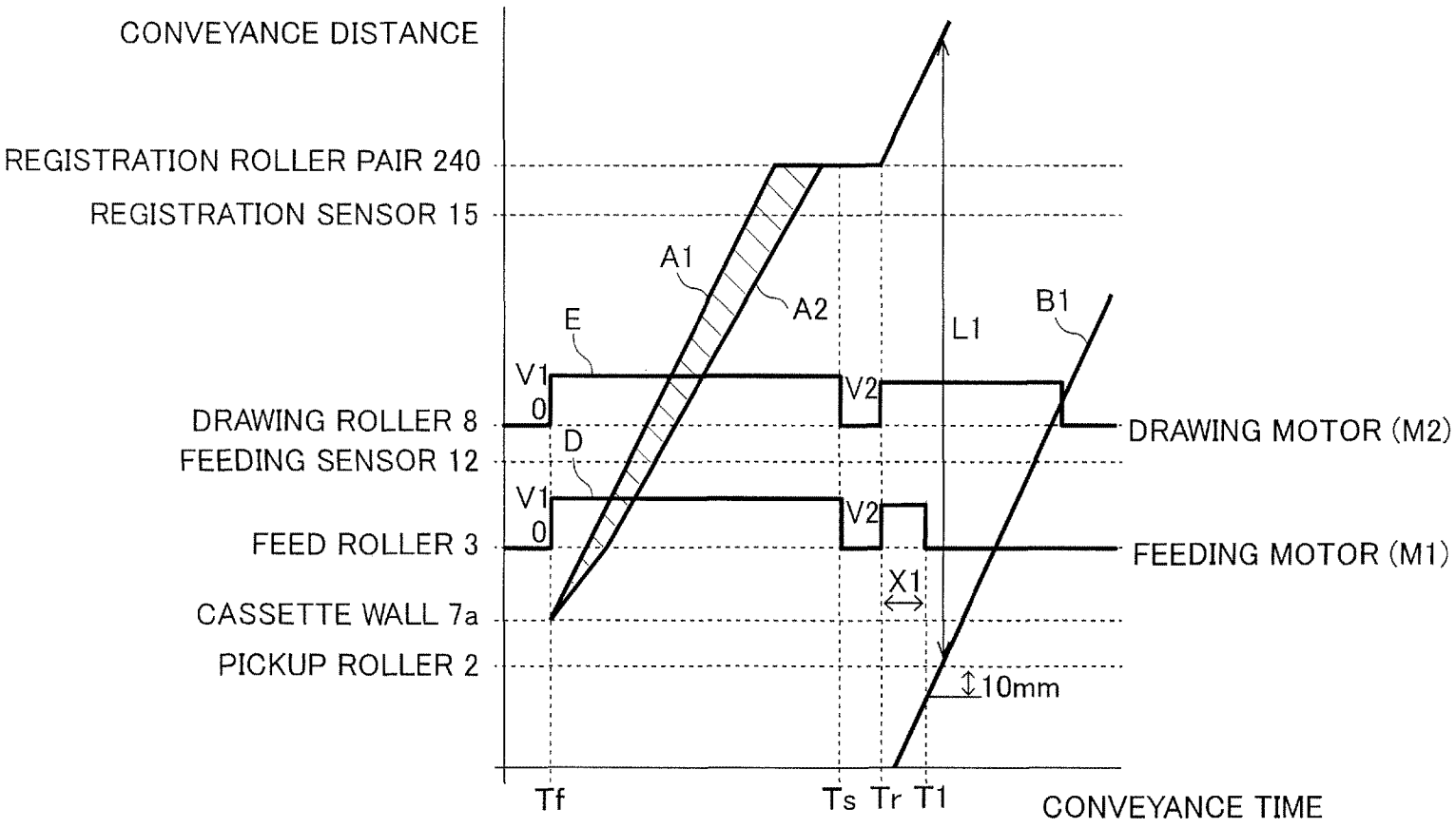
FIG. 6 is a diagram in which a time chart of a first control mode according to the first embodiment is combined with a line diagram indicating a position of a sheet (in a case of a long sheet).

Next, a sheet feeding operation performed in the case where the first control mode is selected will be described with reference to FIG. 6. Here, FIG. 6 is a diagram in which a time chart of drive controls of the feeding motor M1 and the drawing motor M2 is combined with a line diagram indicating a change in positions of the sheet P. The horizontal axis represents time, and the vertical axis represents motor output and a position on a conveyance route (conveyance distance). Output D of the feeding motor M1 is drawn as a peripheral speed of the feed roller 3, and output E of the drawing motor M2 is drawn as a peripheral speed of the drawing roller pair 8. It is noted that, as described above, the output D of the feeding motor M1 is distributed to the feed roller 3, the retard roller 4, and the pickup roller 2.

Theoretical line A1 in the drawings represents a position of the leading edge of the sheet P. Maximum delay line A2 represents a position obtained when a case where the leading edge of the sheet P is most delayed with respect to the theoretical line A1 is assumed, and is set in consideration of lowering of conveyance efficiency or the like due to tolerance of a component or wear of a roller. In other words, an actual position of the leading edge of the sheet P normally passes through a region (shaded area) surrounded by the theoretical line A1 and the maximum delay line A2. In addition, theoretical line B1 represents a set position of the trailing edge of the sheet P, and is computed using a length L1 of the sheet P from the theoretical line A1 of the leading edge.

As shown in FIG. 6, the feeding motor M1 and the drawing motor M2 is started at a time point Tf with output corresponding to the feeding speed V1, so that the feeding operation is started. Then, the uppermost sheet P is fetched out by the pickup roller 2, the leading edge of the sheet P runs over the cassette wall 7*a*, while the sheet starts to move downstream (upward in the drawing) in the feeding direction. The drive of the feeding motor M1 and the drawing motor M2 is temporarily stopped at a time point Ts after the sheet P reaches the registration roller pair 240, and enters a temporal standby mode with the leading end of the sheet P abutting on the registration roller pair 240.

The feeding motor M1 and the drawing motor M2 is restarted in the image forming speed V2, at a time point Tr when the registration roller pair 240 starts to rotate along with a transfer timing in the secondary transfer portion t2. At this time, the pickup roller 2 and the feed roller 3 are driven to rotate in the forward direction, and thereby the conveyance of the sheet P is assisted by the drawing roller pair 8 and the registration roller pair 240.

Then, the feeding motor M1 is stopped at a time point T1 at which the sheet P reaches a first position. Here, the first position means a position of the sheet at which the trailing edge of the sheet P reaches a position separated by a predetermined distance (for example, 10 mm) upstream of a contact position (pickup position) of the pickup roller 2. In detail, the control portion 9 starts counting drive time of the feeding motor M1 with the ON signal of the feeding motor M1 at the time point Tr as a trigger, and computes time (control time X1) to be taken for the sheet P to reach the first position at the image forming speed V2. Then, an OFF signal is transmitted to the feeding motor M1 at a timing (time point T1) at which the drive time is equal to the control time X1. After the feeding motor M1 is stopped, the sheet P continues to be conveyed by the registration roller pair 240 and the drawing roller pair 8, and is conveyed to the secondary transfer portion t2.

It is noted that a stop timing, at which the drive of the feeding motor M1 is stopped, is not limited to a timing at which the trailing edge of the sheet P reaches a position 10 mm downstream of the pickup position. The stop timing is not limited thereto and another timing may be set as long as, in a range of the timing, fetching-out (pickup) of a sheet P stacked under the uppermost sheet P is not performed and conveying force of the drawing roller pair 8 and the registration roller pair 240 is effectively assisted. It is preferable that the first position as the position of the sheet at the stop timing is set in consideration of variations in tolerance of the components or in dimension of the sheet, variations in a set value of the motor output and in the actual rotational speed, or the like. In a certain example to which the embodiment is applied, it is suitable that the first position is set to a position at which the trailing edge of the sheet P moves away from the pickup position in a range from 10 mm to 20 mm.

Second Control Mode

Figure 7:
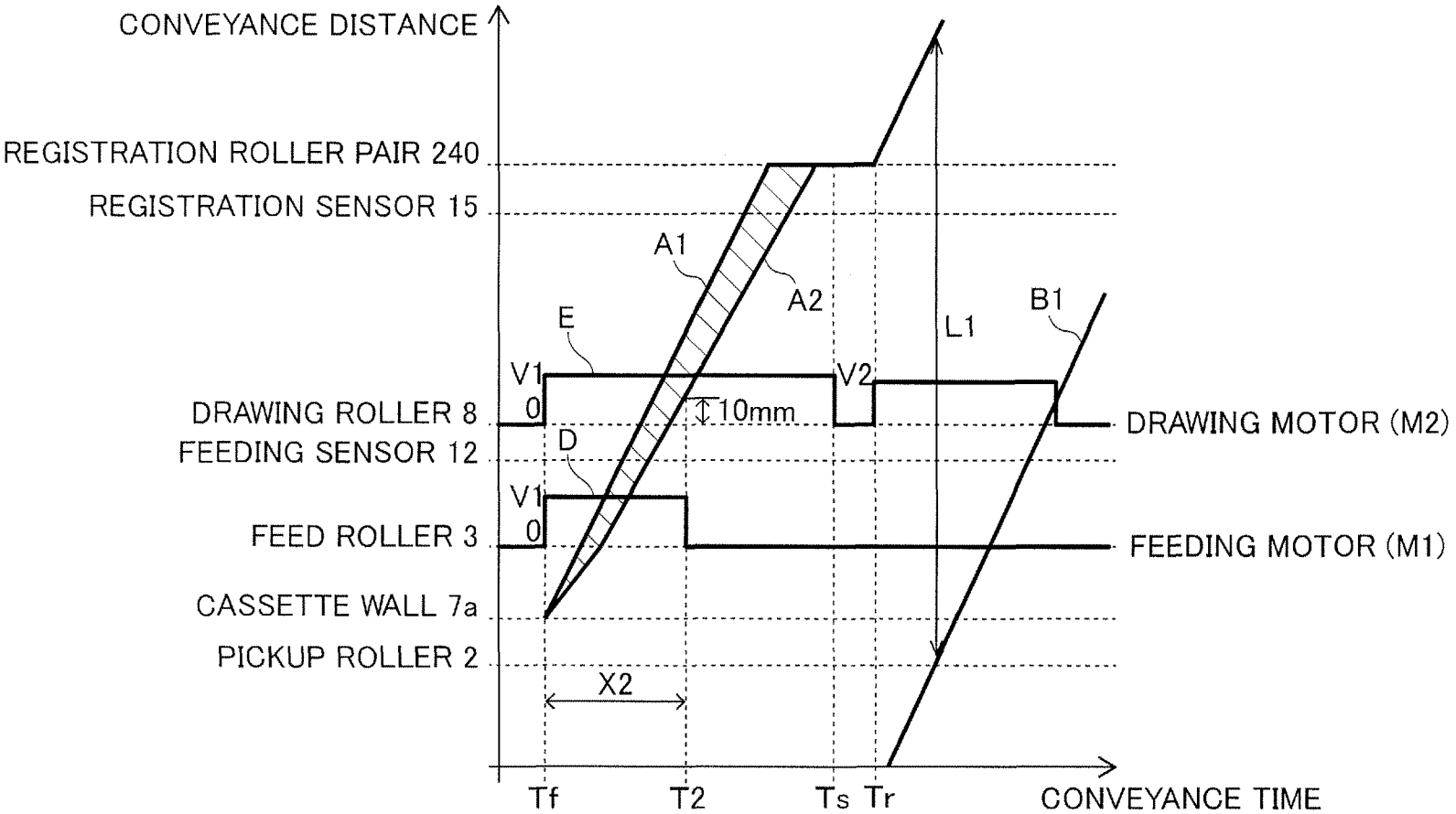
FIG. 7 is a diagram in which a time chart of a second control mode according to the first embodiment is combined with a line diagram indicating a position of a sheet (in a case of a long sheet).

Subsequently, a sheet feeding operation performed in the case where the second control mode is selected will be described with reference to FIG. 7. Here, FIG. 7 is a diagram in which a time chart of drive control of the feeding motor M1 and the drawing motor M2 is combined with a line diagram indicating a change in positions of the sheet P, the horizontal axis represents time, and the vertical axis represents motor output and a position on a conveyance route (conveyance distance). In addition, FIG. 7 shows the sheet feeding operation performed in the case where the sheet P having the same sheet length L1 as in FIG. 6 is conveyed. In the following description, the same reference signs are assigned to the common elements with the first control mode, and description thereof is omitted.

As shown in FIG. 7, the feeding motor M1 and the drawing motor M2 are started with output corresponding to the feeding speed V1, so that the feeding operation is started. Then, the uppermost sheet P is fetched out by the pickup roller 2, and the leading edge of the sheet P starts to move downstream (upward in the drawing) in the feeding direction. Then, the drive of the feeding motor M1 is stopped at a time point T2 at which the sheet P reaches a second position. Here, the second position means a position of the sheet at which the leading edge of the sheet P reaches a position separated by the predetermined distance (for example, 10 mm) downstream of the drawing roller pair 8 and the drawing nip portion N2. In detail, the control portion 9 starts counting drive time of the feeding motor M1 with the ON signal of the feeding motor M1 at the time point Tf as a trigger, and computes time (control time X2) to be taken for the sheet P to reach the second position at the feeding speed V1. Then, an OFF signal is transmitted to the feeding motor M1 at a timing (time point T2) at which the drive time is equal to the control time X2.

Here, the first position is the position of the sheet at which the trailing edge of the sheet P reaches a position separated by the predetermined distance upstream of the contact position of the pickup roller 2. The second position is thus set as a position of the sheet at which the leading edge of the sheet P reaches a position separated by the predetermined distance downstream of the drawing nip portion. In other words, the first position is the position of the sheet with the middle portion of the sheet P in the feeding direction closer to the drawing nip portion N2 than to the contact position of the pickup roller 2. In addition, the second position is the position of the sheet with the middle portion of the sheet P closer to the separation nip portion N1 than to the drawing nip portion N2. Hence, the second position is a position on the upstream side from the first position in the feeding direction, and, as the sheet length L1 is increased, a gap between the first position and the second position is increased.

After the drive of the feeding motor M1 is stopped, the sheet P continues to be conveyed by the drawing roller pair 8 toward the registration roller pair 240. At this time, the pickup roller 2 and the feed roller 3 rotate with the sheet P fetched and idle in the forward direction due to an operation of a one-way clutch. Meanwhile, since the retard roller 4 is connected to the feeding motor M1 via the torque limiter 5 so as to be driven by the feeding motor, rotation in the forward direction is regulated. Hence, also with reference to FIG. 4, the retard roller 4 rotates with the sheet P1 fetched, with the one sheet (Q1) approaching the separation nip portion N1. Meanwhile, in the case where the double feeding state occurs at the separation nip portion N1, the retard roller 4 stops rotating and it is prevented that the retard roller holds the sheet (Q2) other than the uppermost sheet due to the friction force, and conveys the sheet to the drawing nip portion N2 in the double feeding state.

The drawing motor M2 is stopped at the time point Ts after the sheet P reaches the registration roller pair 240, and enters a temporal standby mode with the leading edge of the sheet P abutting on the registration roller pair 240. Then, the drawing motor M2 is restarted at the image forming speed V2 at the time point Tr at which the registration roller pair 240 starts operating, and then the sheet P is conveyed to the secondary transfer portion t2.

It is noted that the stop timing, at which the drive of the feeding motor M1 is stopped, is not limited to a timing at which the leading edge of the sheet P reaches a position 10 mm downstream of the drawing nip portion N2. The stop timing is not limited thereto and it may be set to other timing as long as it is in a range that the sheet P does not slip to fall from the drawing nip portion N2. It is preferable that the second position as the position of the sheet at the stop timing is set in consideration of variations in tolerance of the components or in dimension of the sheet, variations in a set value of the motor output and in the actual rotational speed, or the like. In a certain example to which the present embodiment is applied, it is suitable that the second position is set to a position at which the trailing edge of the sheet P moves away from the pickup position in a range from 10 mm to 20 mm.

Case of Short Sheet

Figure 8:
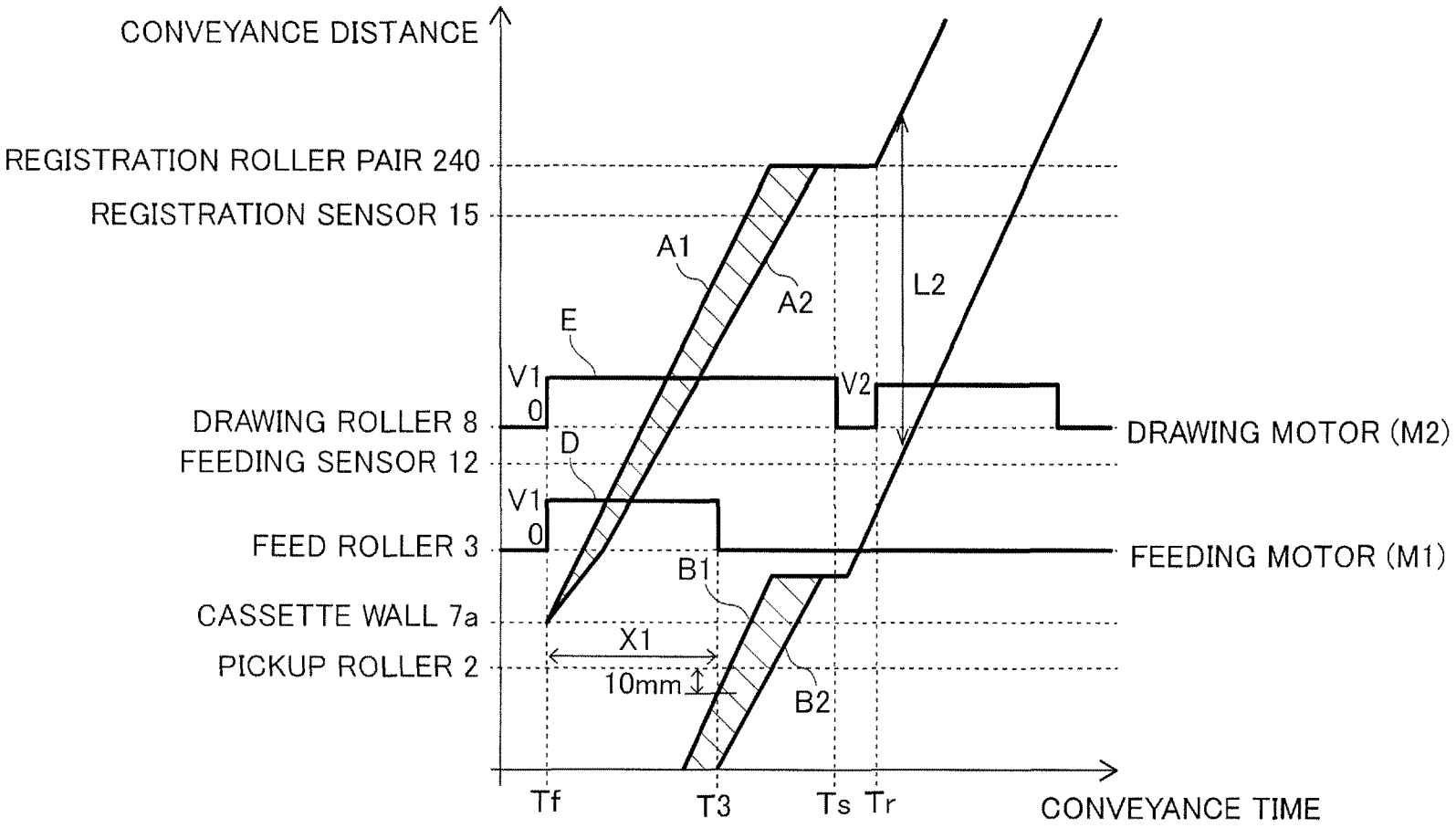
FIG. 8 is a diagram in which a time chart of the first control mode according to the first embodiment is combined with a line diagram indicating a position of a sheet (in a case of a short sheet).
Figure 9:
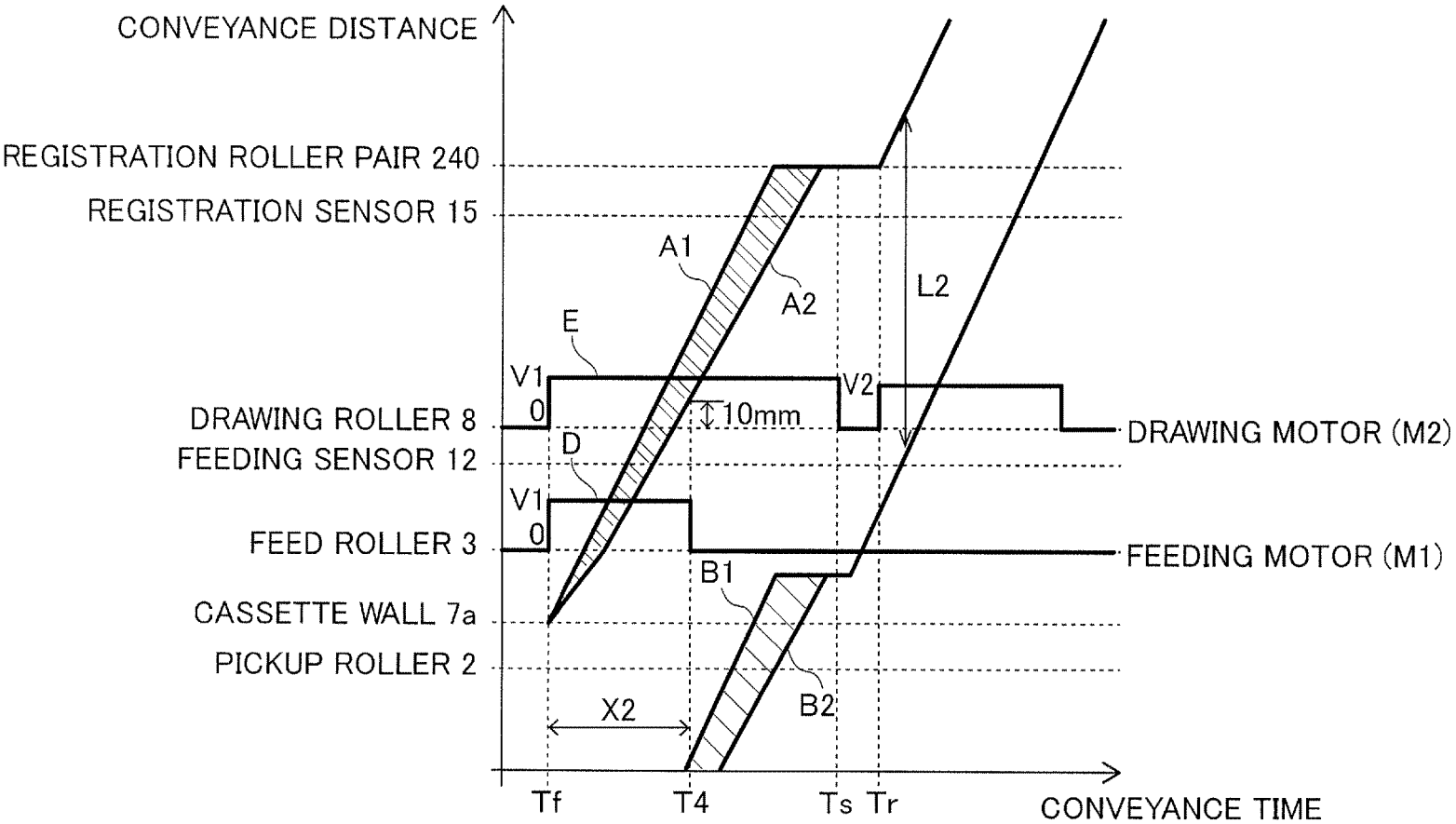
FIG. 9 is a diagram in which a time chart of the second control mode according to the first embodiment is combined with a line diagram indicating a position of a sheet (in a case of a short sheet).

Subsequently, a sheet feeding operation performed in the case where the sheet P has a shorter size than in the cases shown in FIGS. 6 and 7, that is, in the case where a sheet length L2 is relatively short, will be described with reference to FIGS. 8 and 9. Here, a difference from the above-described sheet feeding operation, in which the sheet length L1 is relatively long, will be described, and the same control as in the case where the sheet length is relatively long is omitted. FIGS. 8 and 9 are diagrams in which a time chart of the drive controls of the feeding motor M1 and the drawing motor M2 is combined with a line diagram indicating a change in a position of the sheet P. In addition, maximum delay line B2 in FIGS. 8 and 9 represents a position obtained when a case where the trailing edge of the sheet P is most delayed with respect to the theoretical line B1 is assumed, and is set in consideration of lowering of conveyance efficiency or the like due to tolerance of a component or wear of a roller.

As shown in FIG. 8, in the case where the first control mode is selected, the feeding motor M1 is started, and then the feeding motor M1 is stopped at a time point T3 at which the sheet P reaches the first position. Here, the first position means a position at which the trailing edge of the sheet P reaches a position separated by the predetermined distance (for example, 10 mm) upstream of the contact position of the pickup roller 2. The control portion 9 issues the OFF signal to the feeding motor M1 at a timing (time point T3) after time (control time X1) to be taken from the issuing of the ON signal to the feeding motor M1 at the time point Tf to the reaching of the sheet P to the first position. After the drive of the feeding motor M1 is stopped, the sheet P continues to be conveyed by the drawing roller pair 8, and reaches the registration roller pair 240.

Meanwhile, as shown in FIG. 9, in the case where the second control mode is selected, the feeding motor M1 is started, and then the feeding motor M1 is stopped at a time point T4 at which the sheet P reaches the second position on the upstream side from the first position. Here, the second position means a position at which the leading edge of the sheet P reaches a position separated by the predetermined distance (for example, 10 mm) downstream of the drawing nip portion N2 of the drawing roller pair 8. The control portion 9 issues the OFF signal to the feeding motor M1 at a timing (time point T4) after the elapse of time (control time X2) to be taken from the issuing of the ON signal to the feeding motor M1 at the time point Tf to the reaching of the sheet P to the second position. After the feeding motor M1 is stopped, the sheet P continues to be conveyed by the drawing roller pair 8, and reaches the registration roller pair 240.

Similar to the case of the long sheet (L1) described above, the position (first position) of the sheet when the drive of the feeding motor M1 is stopped in the first control mode is positioned downstream from the position (second position) of the sheet when the feeding motor M1 is stopped in the second control mode. Therefore, in the case where the first control mode is selected, the pickup roller 2 and the feed roller 3 rotate for long in a range in which the sheet P stacked under the uppermost sheet P is not fetched out, and assist the conveyance of the sheet P by the drawing roller pair 8. Meanwhile, in the case where the second control mode is selected, the feeding motor M1 is stopped at an earlier timing than in the first control mode in a range in which the leading edge of the sheet P does not fall down from the drawing nip portion N2, and thus supply of the drive force to the retard roller 4 is blocked.

Control Flow

Figure 10:
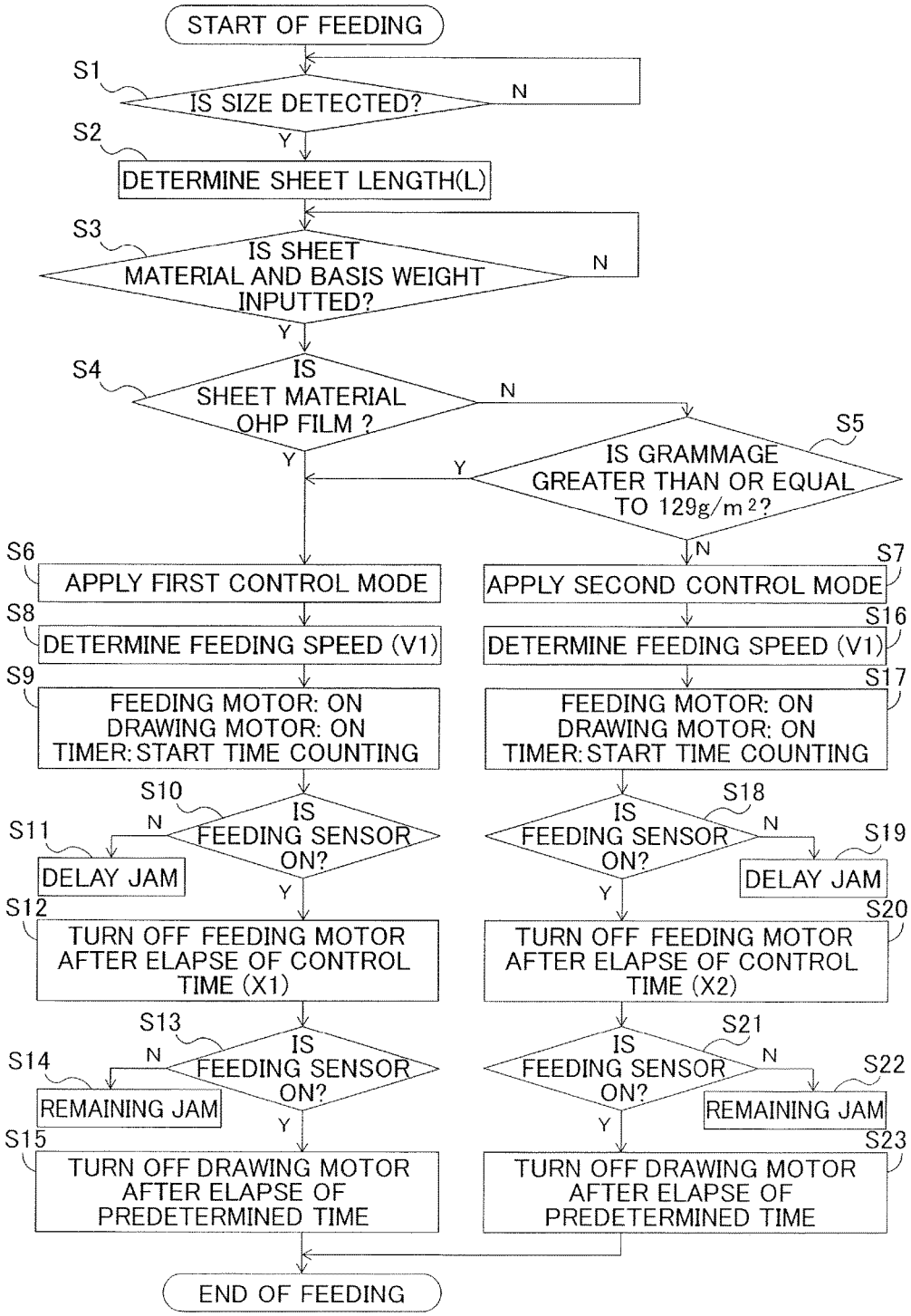
FIG. 10 is a flowchart of a sheet feeding operation according to the first embodiment.

Next, a control process of the sheet feeding operation described above will be described by following a flowchart in FIG. 10. When the sheets P are stacked in the feeding cassette 7 and are accommodated in the apparatus body 201A, the control portion 9 detects a size of the sheet P using the size detection sensor 11 (S1), and then determines the sheet length L (S2). Then, when a user operates the operation panel 10 and selects and inputs types (material and basis weight) of sheet P (S3), the control portion 9 selects a control mode based on the type of sheet P. In other words, in the case where a material of the sheet P is an OHP film (S4: Y), or in the case where the grammage of the sheet P is 129 g/m2 or greater (S5: Y), the first control mode is applied (S6). In addition, in the case where the sheet P is not the OHP film (S4: N) and the grammage of the sheet P is smaller than 129 g/m2 (S5: N), the second control mode is applied (S7).

In the case where the first control mode is selected, the control portion 9 determines the feeding speed V1 (150 mm/sec) with reference to Table 1 (S8). Then, the control portion 9 starts the feeding motor M1 and the drawing motor M2 with the output corresponding to the feeding speed V1, and starts the counting of the drive time of the feeding motor M1 using the timer 13 (S9). Then, in the case where the feeding sensor 12 does not detect the leading edge of the sheet P in a predetermined time (S10: N), it is determined that the feeding of the sheet P is in a state of being delayed, i.e., in a delay jam state (S11), and a process of jam processing including halt processing of image formation is started. In the case where the feeding sensor 12 detects the leading edge of the sheet P in the predetermined time (S10: Y), the feeding motor M1 is stopped at the timing at which the drive time of the feeding motor M1 is equal to the control time X1 (S12). It is noted that, as described above, the control time X1 is computed as the time to be taken to the reaching of the sheet P to the first position.

The control portion 9 continues the drive of the drawing motor M2, and monitors the position of the sheet P using the feeding sensor 12. Then, in the case where the feeding sensor 12 detects the trailing edge of the sheet P in the predetermined time and the OFF signal is not issued (S13: N), the control portion 9 determines that the sheet P is in a state of remaining inside the apparatus body 201A, i.e., in a remaining jam state (S14), and starts the process of jam processing. In the case where the feeding sensor 12 detects the trailing edge of the sheet P in the predetermined time (S13: Y), the drawing motor M2 is stopped (S15) after the elapse of time set so as for the trailing edge of the sheet P to pass through the drawing nip portion N2, the feeding operation is completed.

Meanwhile, in the case where the second control mode is selected, the control portion 9 determines the feeding speed V1 (250 mm/sec or 300 mm/sec) with reference to Table 1 (S16). Then, the control portion 9 starts the feeding motor M1 and the drawing motor M2 with the output corresponding to the feeding speed V1, and starts the counting of the drive time of the feeding motor M1 (S17). Then, in the case where the feeding sensor 12 does not detect the leading edge of the sheet P in the predetermined time (S18: N), the control portion 9 determines that the feeding of the sheet P is in a delay jam state (S19), and starts a process of jam processing. In the case where the feeding sensor 12 detects the leading edge of the sheet P in the predetermined time (S18: Y), the feeding motor M1 is stopped at the timing at which the drive time of the feeding motor M1 is equal to the control time X2 (S20). It is noted that, as described above, the control time X2 is computed as the time to be taken to the reaching of the sheet P to the second position.

The control portion 9 continues the drive of the drawing motor M2, and monitors the position of the sheet P using the feeding sensor 12. Then, in the case where the trailing edge of the sheet P passes over the feeding sensor 12 in the predetermined time and the feeding sensor 12 does not issue the OFF signal (S21: N), the control portion 9 determines that the sheet P is in a remaining jam state (S22), and starts the process of jam processing. In the case where the feeding sensor 12 detects the trailing edge of the sheet P in the predetermined time (S21: Y), the drawing motor M2 is stopped (S23) after the elapse of the time set so as for the trailing edge of the sheet P to pass through the drawing nip portion N2, and the feeding operation is completed.

It is noted that a temporary stopping process performed by abutting the leading edge of the sheet P on the registration roller pair 240 is appropriately included. The temporary stopping process means a process of restarting the drive at the start of the drive of the registration roller pair 240 after the drive of the drawing motor M2 is stopped at the time point Ts (refer to FIGS. 6 to 9) after the leading edge of the sheet P reaches the registration roller pair 240. Here, in the case where the timing at which the sheet P reaches the first position and the second position is later than the temporary stopping process (for example, the case in FIG. 6), the control portion 9 resets a time counting result by the timer 13, and stops the drive of the feeding motor M1 based on elapsed time from the time point Tr.

The present embodiment provides the following advantages. As described above, the sheet feeding apparatus 100A according to the embodiment selects one from the first control mode and the second control mode according to the type of sheet P and executes the selected mode. In the case where the sheet P has high stiffness (large basis weight), the first control mode is selected, and the drive of the feeding motor M1 is stopped with the trailing edge of the sheet P present at the first position separated by the predetermined distance upstream of the contact position of the pickup roller 2. In other words, in the first mode, the pickup roller 2 and the feed roller 3 are driven to rotate in a range in which the sheet stacked under the uppermost sheet P is not fed. In this manner, a conveyance load applied to the drawing roller pair 8 due to bending of a sheet conveyance path, the weight of the sheet, or the like is reduced, and thereby it is possible to improve stability in conveying the sheet by reducing occurrence of slipping in the drawing nip portion N2.

Meanwhile, in the case where the sheet P has low stiffness (small basis weight), the sheet feeding apparatus 100A selects the second control mode, and the drive of the feeding motor M1 is stopped with the leading edge of the sheet P present at the second position separated by the predetermined distance downstream of the drawing nip portion N2. Therefore, in a case of the sheets having the same length, the drive of the feeding motor M1 is stopped with the sheet P present at the second position on the upstream side of the first position. In other words, in the second mode, the drive of the feeding motor M1 is stopped at the early timing in a range in which the sheet P does not fall down from the drawing nip portion N2. In this manner, since the drive force in the backward direction is not inputted to the retard roller 4, the retard roller 4 is prevented from the rotational vibration. Then, even in the case where the sheet P having low stiffness, to which buckling is likely to occur, a period of time in which the rotational vibration can occur to the retard roller 4 is shortened, and thus it is possible to reduce vibration noise.

Then, the second control mode is applied to the sheet P (second sheet) having low stiffness, in general, with lower conveyance resistance, compared to the sheet P having high stiffness (first sheet). Therefore, in the case where the sheet P has low stiffness, it is possible reduce the vibration noise without damage to stability of the sheet conveyance. In other words, the sheet feeding apparatus 100A according to the present embodiment stably conveys the sheet P, and reduces the vibration noise during the operation thereof.

In addition, in the case where the second control mode is selected, the sheet feeding apparatus 100A according to the present embodiment conveys the sheet at the higher feeding speed V1, compared to the case where the first control mode is selected. Hence, in a case where conveyance is performed at the high feeding speed V1 at which the rotational vibration of the retard roller 4 is likely to occur, the drive of the feeding motor M1 is stopped at the earlier timing, compared to a low feeding speed, and thus it is possible to much more effectively reduce the vibration noise during the operation thereof.

Second Embodiment

Next, a sheet feeding operation of the sheet feeding apparatus 100A according to the second embodiment will be described. The sheet feeding apparatus 100A according to the present embodiment differs from that according to the first embodiment described above in that the feeding speed and the image forming speed are fixed, and has the same configuration as that according to the first embodiment except for that difference. Therefore, the same reference signs are assigned to the elements having the same configuration and effects, and description thereof is omitted.

Figure 11:
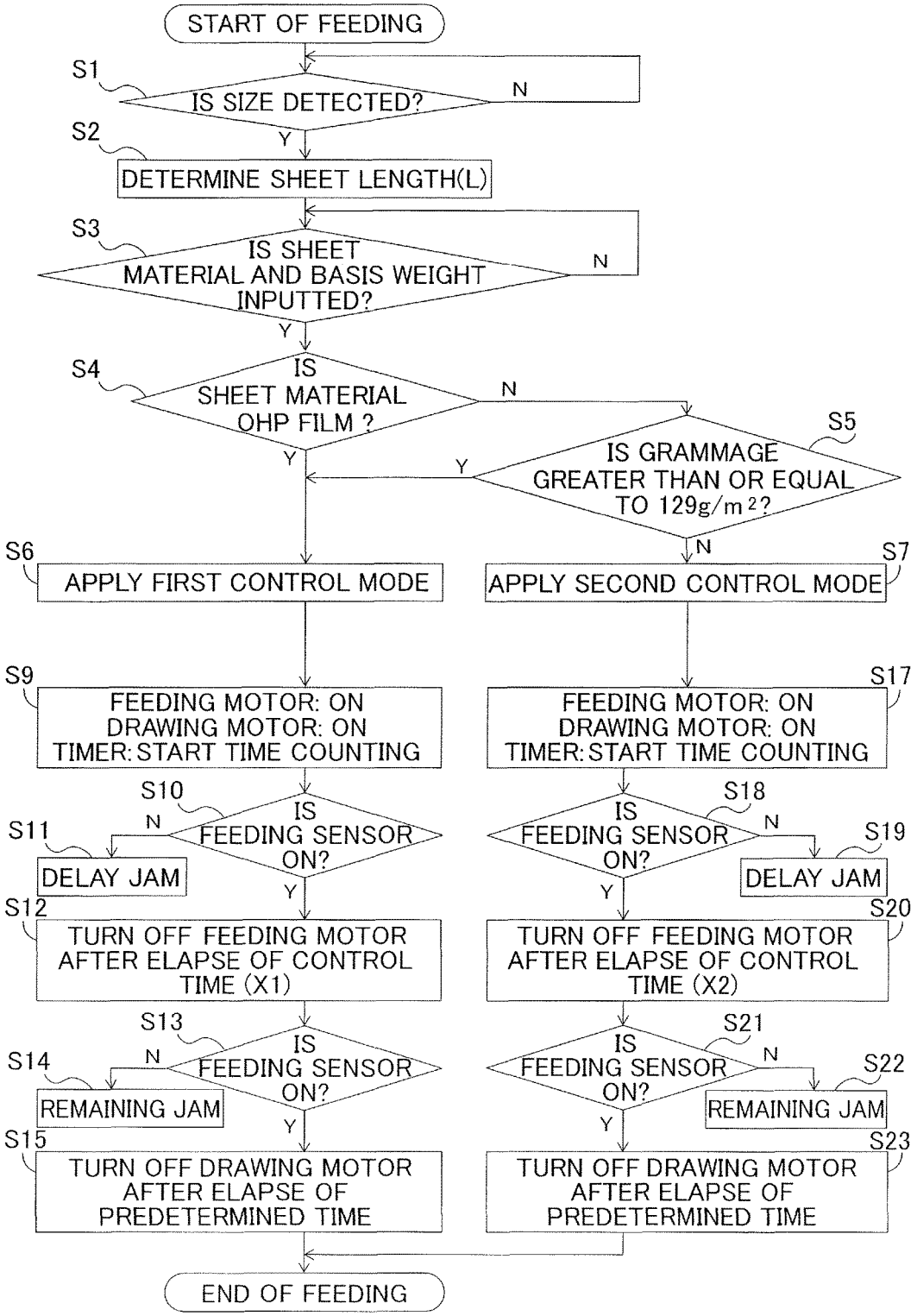
FIG. 11 is a flowchart of a sheet feeding operation according to a second embodiment.

Similar to the first embodiment, the control portion 9 according to the embodiment performs a process of selecting a control mode according to the type of sheet P inputted by a user. In other words, as shown in FIG. 11, when a user operates the operation panel 10 and selects and inputs types (material and basis weight) of sheet P (S3) with the size of the sheet P being detected through the size detection sensor (S1 and S2), the control portion 9 selects a control mode according to the selected and inputted information (S4 and S5). At this time, in the case where a material of the sheet P is an OHP film (S4: Y), or in the case where the grammage of the sheet P is 129 g/m2 or greater (S5: Y), the first control mode is applied (S6). In addition, in the case where the sheet P is not the OHP film (S4: N) and the grammage of the sheet P is smaller than 129 g/m2 (S5: N), the second control mode is applied (S7). Then, the feeding motor M1 and the drawing motor M2 is started and the conveyance of the sheet P is started at a feeding speed used commonly in both the first and second control modes (S9 and S17).

It is noted that the information referred to when the control mode is selected may be limited to a combination of the material (the OHP film or not) and the basis weight of the sheet P, and another item of information may be used. For example, a configuration in which the control mode is selected according to only the basis weight, or according to a combination of classification of high-quality paper, recycled paper, coated paper, or the like, and the basis weight, may be employed. In short, a configuration, in which the first control mode is applied to the sheet P (first sheet) having high stiffness, and the second control mode is applied to the sheet P (second sheet) having low stiffness, may be employed.

The present embodiment provides following advantages. The sheet feeding apparatus 100A according to the present embodiment has a configuration in which the control mode is selected according to the types of sheet P, and thus can be applied to an image forming apparatus in which both the feeding speed V1 and the image forming speed V2 are fixed. Then, the sheet feeding apparatus 100A switches between the first control mode and the second control mode according to the stiffness of the sheet and performs the sheet feeding operation, and thus it is possible to obtain the same merits as those in the first embodiment described above. In other words, the sheet feeding apparatus 100A improves stability in conveying the sheet P and reduces vibration noise during an operation thereof.

Third Embodiment

Next, a sheet feeding operation of the sheet feeding apparatus 100A according to the third embodiment will be described. The sheet feeding apparatus 100A according to the present embodiment differs from that according to the first embodiment described above in that a stop timing of the feeding motor M1 is determined based on a detection signal from the feeding sensor 12. The sheet feeding apparatus has the same configuration as that according to the first embodiment except for that difference, thus the same reference signs are assigned to the elements having the same configuration and effects, and description thereof is omitted.

Case of Long Sheet

Figure 12:
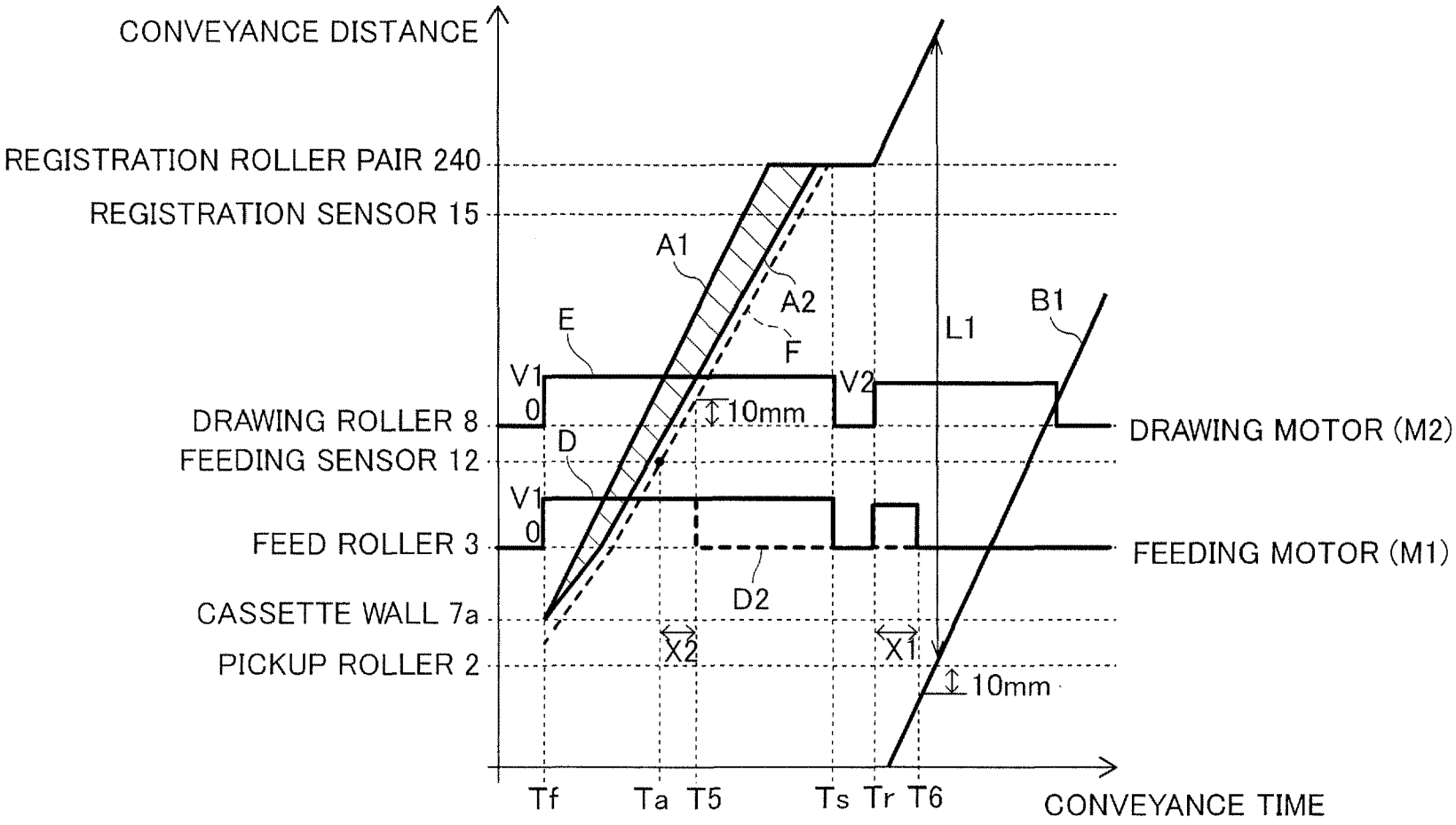
FIG. 12 is a diagram in which a time chart according to a third embodiment is combined with a line diagram indicating a position of a sheet (in a case of a long sheet).

In addition, a sheet feeding operation performed when the sheet P having relatively long sheet length L1 is conveyed will be described with reference to FIG. 12. Here, FIG. 12 is a diagram in which a time chart of drive controls of the feeding motor M1 and the drawing motor M2 is combined with a line diagram indicating a change in positions of the sheet P. Dashed line D2 in FIG. 12 represents output of the feeding motor M1 in the second control mode, as a difference from the output D in the first control mode. In addition, dashed line F in FIG. 12 represents a position of the leading edge of the sheet P detected in the case where the sheet is conveyed by being more delayed than the maximum delay line A2.

As shown in FIG. 12, in the case where the first control mode is applied, the feeding motor M1 and the drawing motor M2 started at the time point Tf, and then are temporarily stopped at the time point Ts. Then, the feeding motor M1 is restarted at the time point Tr in accordance with the start of the drive of the registration roller pair 240, and then stopped at a timing (time point T6) after the control time X1 elapses. Here, the control time X1 is time computed so as for the trailing edge of the sheet P to reach, at the image forming speed V2, a position (first position) separated by a predetermined distance downstream of the contact position of the pickup roller 2.

Meanwhile, in the case where the second control mode is applied, the feeding motor M1 is started at the time point Tf, and then stopped at a timing (time point T5) after the control time X2 elapses after the feeding sensor 12 issues the ON signal at a time point Ta (dashed line D2). Here, the control time X2 is time computed so as for the leading edge of the sheet to reach, at the feeding speed V1, a position (second position) separated by a predetermined distance downstream of the drawing nip portion N2, after the feeding sensor 12 detects the leading edge of the sheet P. Hence, in the case where the leading edge of the sheet P is conveyed by being delayed further than the maximum delay line A2 as shown as the dashed line F, the driving of the feeding motor M1 is stopped at the later timing (time point T5), compared to the first embodiment (refer to the time point T2 in FIG. 7).

Case of Short Sheet

Figure 13:
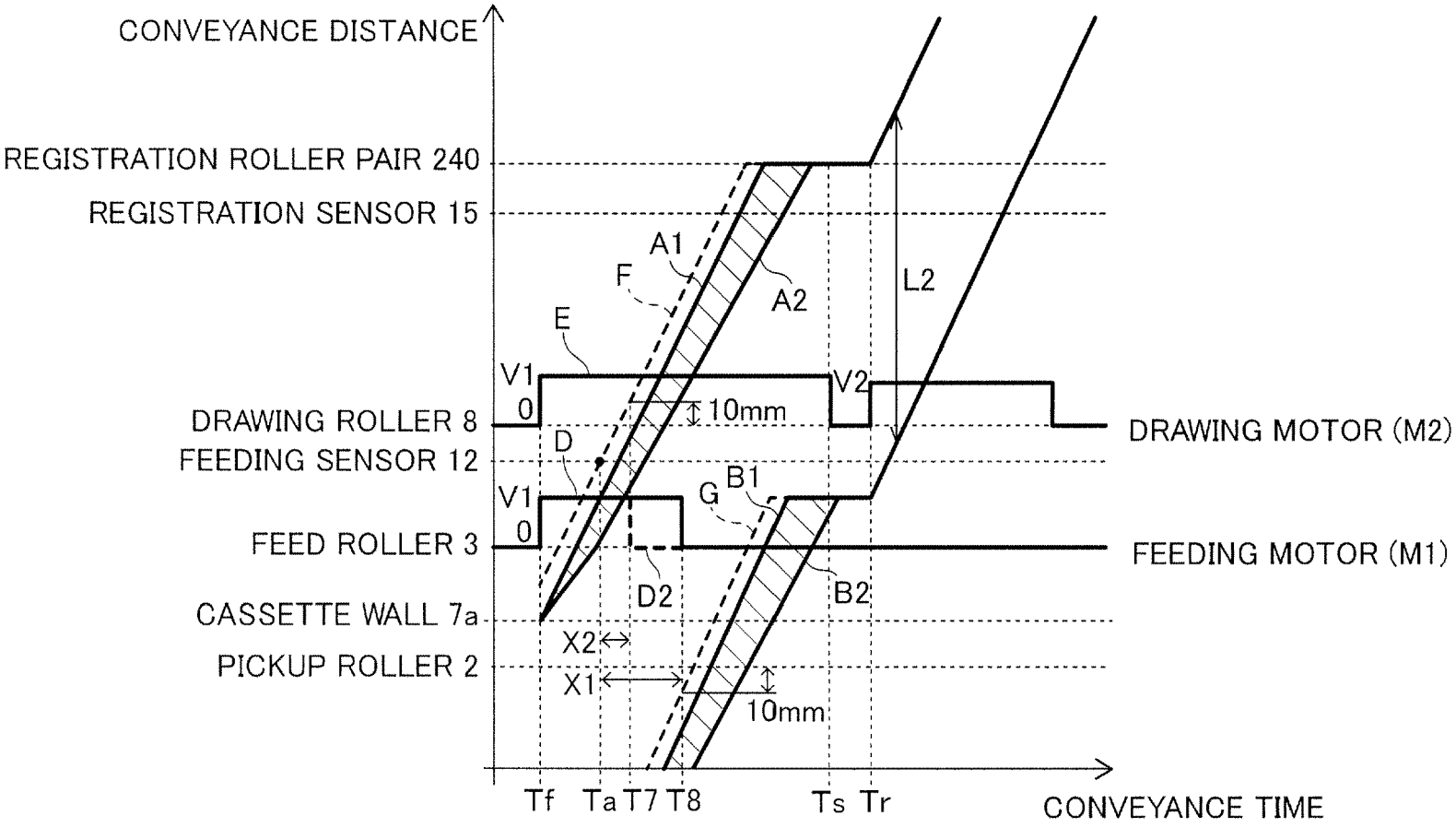
FIG. 13 is a diagram in which a time chart according to the third embodiment is combined with a line diagram indicating a position of a sheet (in a case of a short sheet).

Next, a sheet feeding operation performed when the sheet P having a sheet length L2 relatively shorter than L1 is conveyed will be described with reference to FIG. 13. Here, FIG. 13 is a diagram in which a time chart of drive controls of the feeding motor M1 and the drawing motor M2 is combined with a line diagram indicating a change in positions of the sheet P. Dashed line D2 in FIG. 12 represents output of the feeding motor M1 in the second control mode, as a difference from the output D in the first control mode. In addition, dashed line F in FIG. 13 represents a position of the leading edge of the sheet P detected in the case where the sheet is conveyed earlier than the theoretical line A1, and dashed line G represents a position of the trailing edge of the sheet P.

As shown in FIG. 13, in the case where the first control mode is applied, the feeding motor M1 and the drawing motor M2 is started at the time point Tf, and then stopped at a timing (time point T8) after the control time X1 elapses after the feeding sensor 12 issues the ON signal at the time point Ta. Here, the control time X1 is time computed so as for the trailing edge of the sheet P to reach, at the feeding speed V1, a position (first position) separated by a predetermined distance upstream of the contact position of the pickup roller 2. Hence, in the case where the sheet P is conveyed earlier than the theoretical line B1, the driving of the feeding motor M1 is stopped at the earlier timing (time point T8), compared to the first embodiment (refer to the time point T3 in FIG. 8).

Meanwhile, in the case where the second control mode is applied, the feeding motor M1 is started at the time point Tf, and then stopped at a timing (time point T7) after the control time X2 elapses after the feeding sensor 12 issues the ON signal at the time point Ta (dashed line D2). Here, the control time X2 is time computed so as for the leading edge of the sheet to reach, at the feeding speed V1, a position (second position) separated by a predetermined distance downstream of the drawing nip portion N2. Hence, in the case where the sheet P is conveyed earlier than the theoretical line A1, the feeding motor M1 is stopped at the earlier timing (time point T7), compared to the first embodiment (refer to the time point T4 in FIG. 9).

Figure 14:
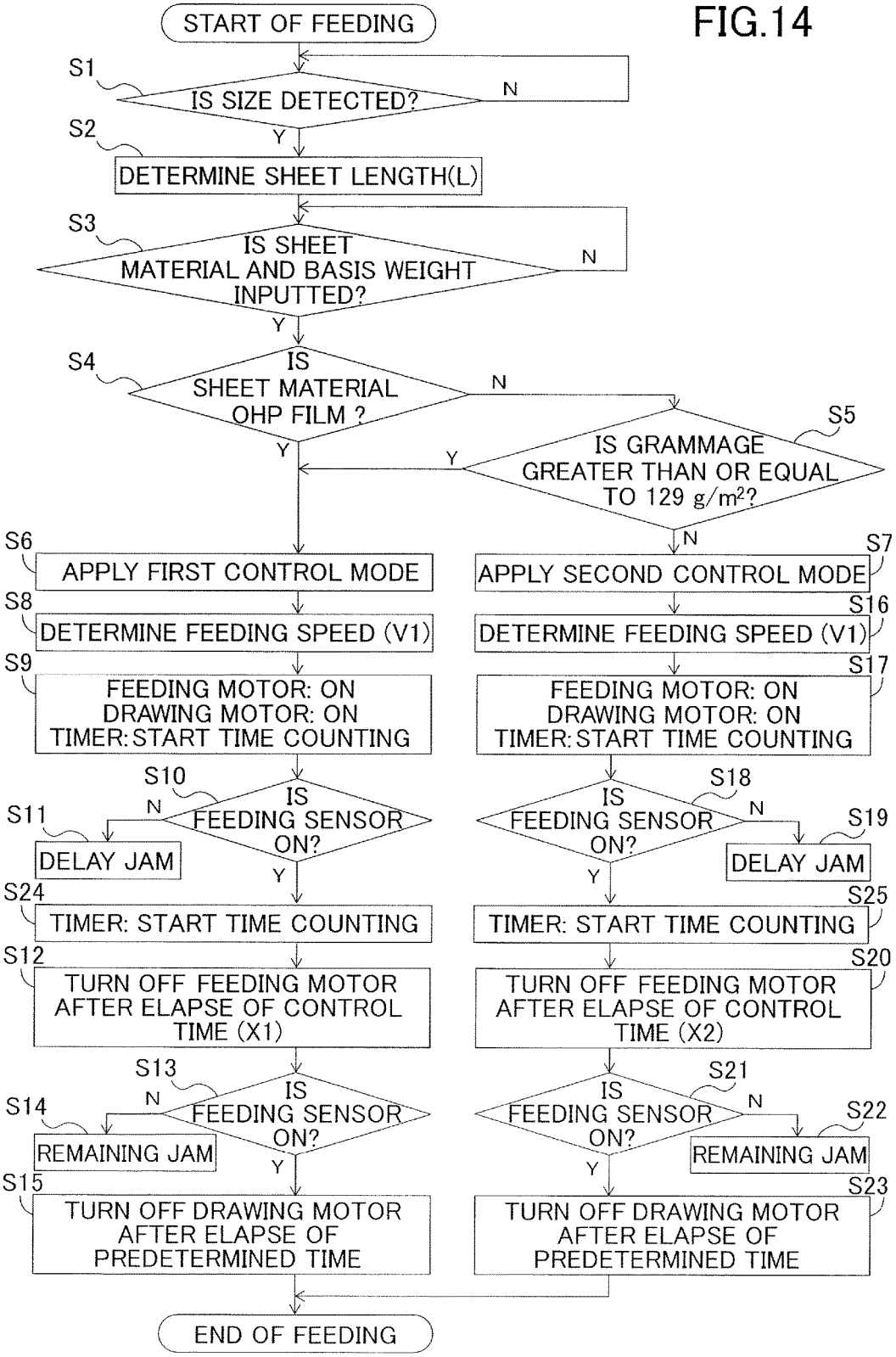
FIG. 14 is a flowchart of a sheet feeding operation according to a third embodiment.

As shown in a flowchart in FIG. 14, the control portion 9 according to the embodiment starts time counting by the timer 13 (S24 and S25) with the issue of the ON signal by the feeding sensor 12 as a condition (S10: Y and S18: Y). Then, in the case where the first control mode is applied, the feeding motor M1 is stopped at a timing after the control time X1 elapses from the start of time counting (S12). In addition, in the case where the second control mode is applied, the feeding motor M1 is stopped at a timing after the control time X2 elapses from the start of time counting (S20).

The present embodiment provides the following advantages. In the sheet feeding apparatus 100A according to the embodiment, the feeding speed V1 is determined according to the stiffness of the sheet P, and a control mode is selected according to a value of the feeding speed V1. Thus, it is possible to obtain the same merits as those in the first embodiment described above. In other words, the sheet feeding apparatus 100A improves stability in conveying the sheet P and reduces vibration noise during an operation thereof.

Incidentally, as shown in FIG. 12, in the case where the sheet P is set at a position shifted from a set position in design of the feeding cassette 7 (dashed line F), or the like, the leading edge of the sheet P is conveyed by being delayed further than the maximum delay line A2 in some cases. In this case, in a configuration in which the stop timing of the feeding motor M1 is determined based on the maximum delay line A2, the drive of the feeding motor M1 is likely to be stopped before the sheet P is delivered to the drawing nip portion N2, and thus there is a possibility that the sheet P is likely to remain inside the apparatus. By comparison, in the sheet feeding apparatus 100A according to the present embodiment, the stop timing of the feeding motor M1 is delayed according to the delay of the sheet P, based on a detection signal of the feeding sensor 12. Therefore, it is possible to reliably deliver the sheet P to the drawing nip portion N2 even in the case where the sheet P is delayed further from a normal range.

In addition, as shown in FIG. 13, in the case where the sheet P is set at a position shifted from a set position (dashed lines F and G), or the like, the sheet P is conveyed earlier than the theoretical lines A1 and B1. In this case, in a configuration in which the stop timing of the feeding motor M1 is determined based on the theoretical line B1, there is a possibility that the feeding motor M1 will be continuously performed regardless of that the actual trailing edge of the sheet P moves downstream of the pickup roller 2. In the case where the drive of the feeding motor M1 is continuously performed, the pickup roller 2 is likely to fetch out the sheet (next sheet) stacked under the uppermost sheet. Then, the next sheet P is shifted to a position on the downstream side further than a normal position, thereby further resulting in a positional shift of the next sheet P. Thus there is a concern that the positional shift of the sheet P is accumulated and the sheet P might interfere with the sheet feeding operation. By comparison, in the sheet feeding apparatus according to the present embodiment, the feeding motor M1 is stopped at an earlier timing according to the timing of the early arriving of the sheet P, in response to the detection signal of the feeding sensor 12. Therefore, even in a case where the sheet P early arrives out of the normal range, a positional shift of the next sheet P is prevented, and thus it is possible to further improve stability in the sheet feeding operation of the sheet feeding apparatus 100A.

Fourth Embodiment

Next, a sheet feeding operation of the sheet feeding apparatus 100A according to the fourth embodiment will be described. Similar to the third embodiment described above, in the sheet feeding apparatus 100A according to the present embodiment, the feeding motor M1 is stopped based on the detection signal from the feeding sensor 12. However, the sheet feeding apparatus 100A according to the present embodiment differs from that according to the third embodiment in that the feeding speed is changed during the sheet feeding operation. Hereinafter, the same reference signs are assigned to the elements having the same configuration and effects as those in the third embodiment, and description thereof is omitted.

Figure 15:
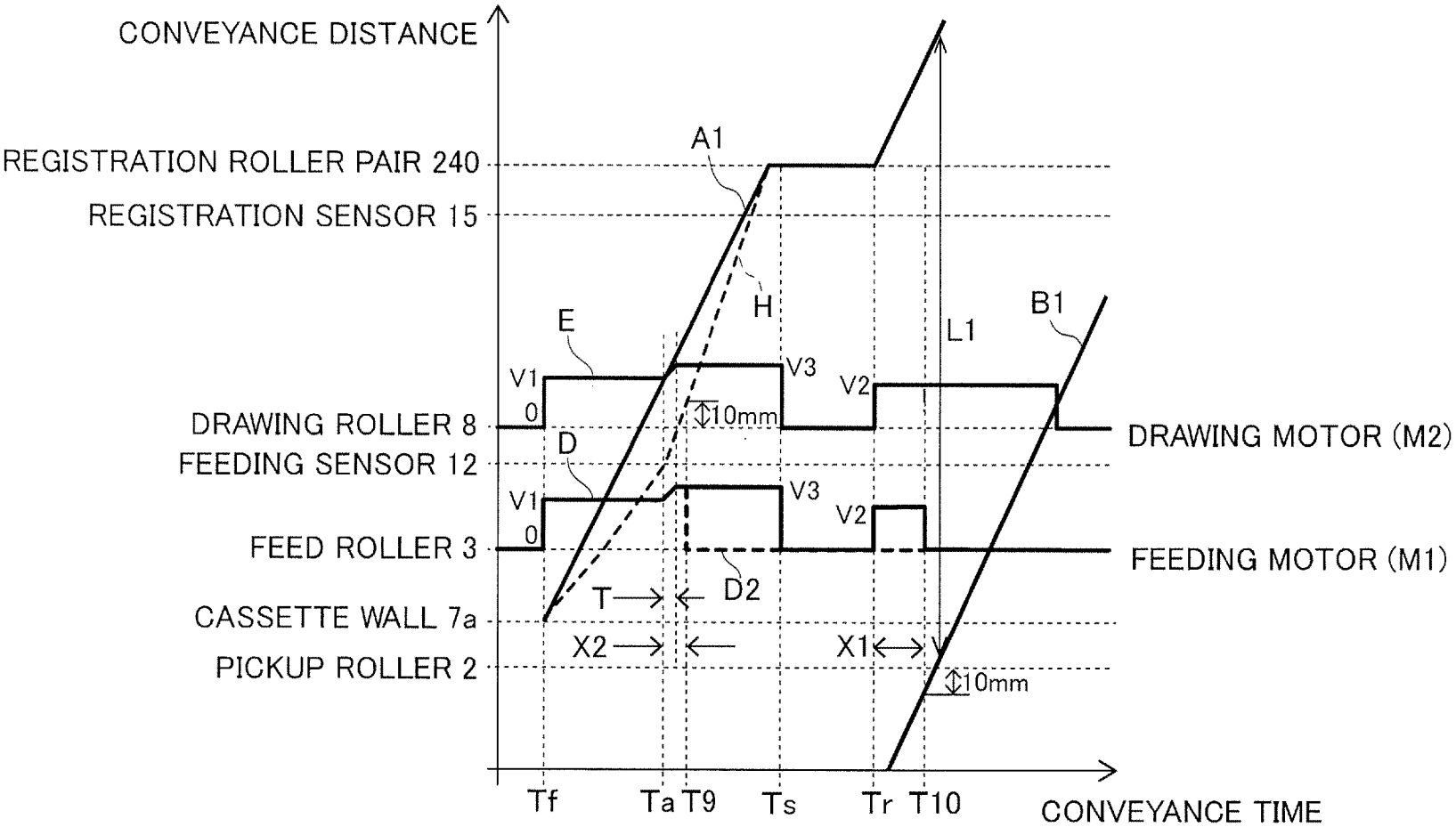
FIG. 15 is a diagram in which a time chart according to a fourth embodiment is combined with a line diagram indicating a position of a sheet.

FIG. 15 is a diagram in which a time chart of drive controls of the feeding motor M1 and the drawing motor M2 is combined with a line diagram indicating a change in positions of the sheet P. Dashed line D2 in FIG. 12 represents output of the feeding motor M1 in the second control mode, as a difference from the output D in the first control mode. In addition, a trajectory H represented by a dashed line in FIG. 15 illustrates a trajectory which the leading edge of the sheet P actually follows.

As shown in FIG. 15, when the feeding sensor 12 detects the leading edge of the sheet P, the control portion 9 changes a drive speed of the feeding motor M1 and the drawing motor M2 from V1 to V3. In this case, the drive speed increases from V1 in the case where the detection timing is delayed with respect to the theoretical line A1 as the trajectory H, and the drive speed decreases from V1 in the case where the detection timing is earlier with respect to the theoretical line A1. In other words, the control portion 9 changes the drive speed of the feeding motor M1 and the drawing motor M2 so as to reduce variations in the elapsed time from the start of the feeding motor M1 to the detection of the leading edge of the sheet P by the feeding sensor 12.

Incidentally, when the drive speed of the feeding motor M1 and the drawing motor M2 is changed from V1 to V3, the speed is changed during a period of speed-changing time T as a width of time determined by response characteristics of the motors. During the period of speed-changing time T, the torque load in the forward direction transmitted to the retard roller 4 is irregularly changed. In addition, since response of the torque limiter 5 to the change in the torque loads, normally, depends on a certain degree of delay, a further unstable force in the backward direction is applied to the sheet P from the retard roller 4 during the period of speed-changing time T than during a period of time before and after the speed-changing time. Then, in the case where the speed is changed in a state in which the drive force in the backward direction is not inputted to the retard roller 4, there is a possibility of an occurrence of double feeding.

The sheet feeding apparatus 100A according to the present embodiment is set such that the stop timing of the feeding motor M1 is set after the completion of the speed change at least in the case where the second control mode is applied. In other words, as shown in FIG. 15, after the feeding sensor 12 detects the leading edge of the sheet at the time point Ta and the change in the drive speed is started, the feeding motor M1 is stopped at a timing (time point T9) after the control time X2 longer than the speed-changing time T elapses (refer to the dashed line D2). Here, the control time X2 is time computed so as for the leading edge of the sheet P to reach the position (second position) separated by the predetermined distance downstream of the drawing nip portion N2. By comparison, in the case where the first control mode is applied, similar to the third embodiment described above, the feeding motor M1 is stopped at a timing (time point T10) at which the trailing edge of the sheet P reaches the position (first position) separated by the predetermined distance upstream of the contact position of the pickup roller 2.

Figure 16:
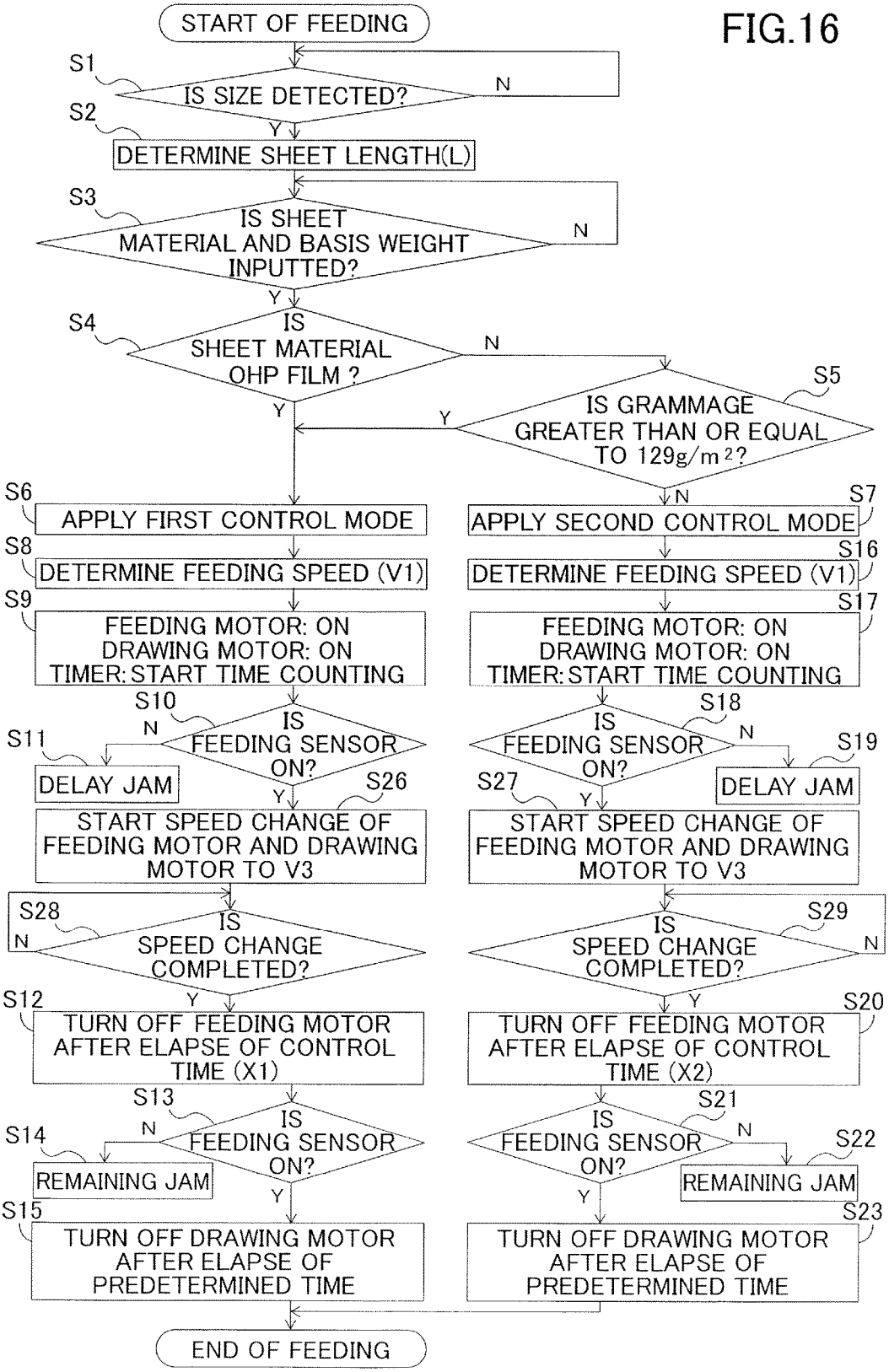
FIG. 16 is a flowchart of a sheet feeding operation according to a fourth embodiment.

As shown in FIG. 16, the control portion 9 according to the embodiment starts speed changing of the feeding motor M1 and the drawing motor M2 with the issue of the ON signal by the feeding sensor 12 as a condition (S10: Y and S18: Y) and starts time counting by the timer 13 (S26 and S27). Then, after the motors are in a standby mode until the speed change from V1 to V3 is completed (S28 and S29), the feeding motor M1 is stopped at a timing after the control times X1 and X2 elapse from the start of the time counting (S12 and S20).

The present embodiment provides the following advantages. The control portion 9 of the sheet feeding apparatus 100A according to the present embodiment causes the drive speed of the feeding motor M1 and the drawing motor M2 to be changed based on the detection signal from the feeding sensor 12. In this manner, a range of the variations in the elapsed time from the start of the sheet feeding operation (time point Tf) to reaching of the leading edge of the sheet P to the registration roller pair 240 is reduced. Then, when a plurality of sheets P are continually conveyed, it is possible to reduce a gap between sheets and thus to improve productivity of the image forming apparatus 201.

Then, in this configuration, the stop timing of the feeding motor M1 is set after the completion of the speed change of the feeding motor M1 and the drawing motor M2 and after the sheet P reaches the second position. Hence, the drive force in the backward direction is applied to the retard roller 4 during a period of speed-changing time T during which the double feeding is likely to occur such that the double feeding is prevented, while the feeding motor M1 is stopped as soon as possible after the completion of the speed change so as to reduce the production of the vibration noise.

It is noted that, in a configuration in which the stop timing of the feeding motor M1 in the second control mode is set after the completion of the speed change and after the sheet P reaches the second position, for example, the feeding sensor 12 may be positioned on the downstream of the drawing nip portion N2. By comparison, in the example described above, the feeding sensor 12 is disposed between the separation nip portion N1 and the drawing nip portion N2 in the feeding direction (refer to FIG. 3), and the speed change of the feeding motor M1 and the drawing motor M2 is completed before the leading edge of the sheet P reaches the drawing nip portion N2. Therefore, when compared to the third embodiment, it is suitable that the drive time of the feeding motor M1 is not elongated due to the standby until the speed change is completed.

Other Embodiments

In the first to fourth embodiments, the drive unit is provided as a single motor; however, a drive unit, including a motor, that drives the feed roller 3 and a drive unit that drives the retard roller 4 may be provided separately. In this case, the stop timing of the feeding motor M1 means a timing at which all the motors enter a stopping state.

It is noted that although the drawing roller pair 8 is positioned downstream of the feed roller 3 and the retard roller 4 in the above described embodiment, a configuration in which, for example, a registration roller pair is positioned downstream thereof may be employed. In short, a configuration in which a conveyance portion having a conveyance nip potion, at which the sheet P is nipped, is arranged downstream of the separation nip portion N1 and conveying the sheet is included may be employed.

Embodiments of the present invention can also be realized by a computer of a system or apparatus that reads out and executes computer executable instructions recorded on a storage medium (e.g., non-transitory computer-readable storage medium) to perform the functions of one or more of the above-described embodiments of the present invention, and by a method performed by the computer of the system or apparatus by, for example, reading out and executing the computer executable instructions from the storage medium to perform the functions of one or more of the above-described embodiments. The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-173510, filed on Sep. 3, 2015, which is hereby incorporated by reference herein in its entirety.

What is claimed is:

1. A sheet feeding apparatus comprising:

a feed roller configured to feed a sheet in a feeding direction;

a drive unit configured to drive the feed roller;

a separation roller driven by the drive unit through a torque limiter in a direction against the feeding direction so that the sheet is separated from another sheet at a separation nip portion formed between the feed roller and the separation roller;

a pair of conveyance rollers configured to convey the sheet at a conveyance nip portion formed between the pair of conveyance rollers, the conveyance nip portion being disposed downstream of the separation nip portion in the feeding direction; and a control portion configured to execute a first control mode in which a first sheet is conveyed and a second control mode in which a second sheet having a lower basis weight than that of the first sheet is conveyed, the control portion being configured to stop the drive unit with the sheet nipped at both nips of the separation nip portion and the conveyance nip portion in each of the first and second control modes, a timing when the drive unit is stopped by the control portion in the second control mode being earlier than a timing when the drive unit is stopped by the control portion in the first control mode, wherein the control portion is configured to control the drive unit such that a rotation speed of the feed roller in the second control mode is set higher than that in the first control mode.

2. The sheet feeding apparatus according to claim 1, wherein the control portion stops the drive unit with the first sheet at a first position in the first control mode and stops the drive unit with the second sheet at a second position in the second control mode, the second position being located upstream of the first position in the feeding direction if the first and second sheets have the same length in the feeding direction.

3. The sheet feeding apparatus according to claim 1, wherein in the second control mode, the control portion stops the drive unit with a middle portion of the second sheet in the feeding direction at a position closer to the separation nip portion than to the conveyance nip portion.

4. The sheet feeding apparatus according to claim 1, wherein in the second control mode, the control portion stops the drive unit with a leading edge of the second sheet at a position located downstream of the conveyance nip portion in the feeding direction in a range from 10 mm to 20 mm.

5. The sheet feeding apparatus according to claim 1, further comprising a pickup roller configured to come into contact with the sheet at a contact position located upstream of the separation nip portion in the feeding direction so as to convey the sheet in the feeding direction, wherein in the first control mode, the control portion stops the drive unit if a trailing edge of the first sheet reaches the contact position.

6. The sheet feeding apparatus according to claim 1, further comprising a pickup roller configured to come into contact with the sheet at a contact position located upstream of the separation nip portion in the feeding direction so as to convey the sheet in the feeding direction, wherein in the first control mode, the control portion stops the drive unit with a middle portion of the first sheet at a position located closer to the conveyance nip portion than to the contact position in the feeding direction.

7. The sheet feeding apparatus according to claim 6, wherein in the first control mode, the control portion stops the drive unit with a trailing edge of the first sheet at a position located upstream of the contact position in the feeding direction in a range from 10 mm to 20 mm.

8. The sheet feeding apparatus according to claim 1, further comprising a conveyance motor configured to drive the pair of conveyance rollers, wherein the drive unit is a motor provided separately from the conveyance motor.

9. The sheet feeding apparatus according to claim 1, further comprising an input portion through which a sheet type of sheets to be conveyed by the feed roller is inputted, wherein the control portion selects the first control mode or the second control mode based on the sheet type inputted through the input portion.

10. The sheet feeding apparatus according to claim 1, further comprising a time count portion configured to count elapsed time after the drive unit is started, wherein the control portion stops the drive unit in response to a signal from the time count portion.

11. The sheet feeding apparatus according to claim 1, further comprising:

a sheet detection portion disposed downstream of the separation nip portion in the feeding direction and capable of detecting the sheet; and a time count portion configured to count elapsed time after the sheet detection portion detects a leading edge of a sheet, wherein the control portion stops the drive unit in response to signals from the sheet detection portion and the time count portion.

12. The sheet feeding apparatus according to claim 11, wherein the control portion is configured to change a conveyance speed of the sheet by the pair of conveyance rollers in response to a detection signal from the sheet detection portion, so as to attenuate variation in elapsed time from the start of the drive unit to the detection of a leading edge of a sheet by the sheet detection portion, and to stop the drive unit after a change in the speed of the pair of conveyance roller is completed.

13. An image forming apparatus comprising:

the sheet feeding apparatus according to claim 1; and an image forming unit configured to form an image on the sheet fed from the sheet feeding apparatus.

14. A sheet feeding apparatus comprising:

a feed roller configured to feed a sheet in a feeding direction;

a supporting portion configured to support the sheet to be fed by the feed roller;

a size detection portion capable of detecting a length in the feeding direction of the sheet supported on the supporting portion;

a drive unit configured to drive the feed roller;

a separation roller driven by the drive unit through a torque limiter in a direction against the feeding direction so that the sheet is separated from another sheet at a separation nip portion formed between the feed roller and the separation roller;

a pair of conveyance rollers configured to convey the sheet at a conveyance nip portion formed between the pair of conveyance rollers, the conveyance nip portion being disposed downstream of the separation nip portion in the feeding direction; and a control portion configured to execute a first control mode in which a first sheet is conveyed and a second control mode in which a second sheet having a lower basis weight than that of the first sheet is conveyed, the control portion being configured to stop the drive unit with the sheet nipped at both nips of the separation nip portion and the conveyance nip portion in each of the first and second control modes, a timing when the drive unit is stopped by the control portion in the second control mode being earlier than a timing when the drive unit is stopped by the control portion in the first control mode, wherein the control portion is configured to change the timing when the drive unit is stopped in the first control mode based on the length in the feeding direction of the sheet detected by the size detection portion.

15. A sheet feeding apparatus comprising:

a feed roller configured to feed a sheet in a feeding direction;

a pickup roller configured to come into contact with the sheet at a contact position to convey the sheet in the feeding direction toward the feed roller;

a drive unit configured to drive the feed roller;

a separation roller driven by the drive unit through a torque limiter in a direction against the feeding direction so that the sheet is separated from another sheet at a separation nip portion formed between the feed roller and the separation roller;

a pair of conveyance rollers configured to convey the sheet at a conveyance nip portion formed between the pair of conveyance rollers, the conveyance nip portion being disposed downstream of the separation nip portion in the feeding direction;

a pair of registration rollers disposed downstream of the conveyance nip portion in the feeding direction and configured to nip and convey the sheet received from the pair of conveyance rollers; and a control portion configured to execute a first control mode in which a first sheet is conveyed and a second control mode in which a second sheet having a lower basis weight than that of the first sheet is conveyed, the control portion being configured to stop the drive unit with the sheet nipped at both nips of the separation nip portion and the conveyance nip portion in each of the first and second control modes, a timing when the drive unit is stopped by the control portion in the second control mode being earlier than a timing when the drive unit is stopped by the control portion in the first control mode, wherein in a case where the first sheet is longer than an interval between the pickup roller and the pair of registration rollers, the control portion stops the drive unit after a leading edge of the first sheet reaches the pair of registration rollers in the first control mode, and stops the drive unit before the leading edge of the second sheet reaches the pair of registration rollers in the second control mode.

* * * * *